US010815084B2

(12) United States Patent
Suto et al.

(10) Patent No.: US 10,815,084 B2
(45) Date of Patent: Oct. 27, 2020

(54) SHEET FEED APPARATUS AND IMAGE FORMING APPARATUS HAVING THE SAME

(71) Applicant: Sharp Kabushiki Kaisha, Osaka (JP)

(72) Inventors: Yasuhiro Suto, Osaka (JP); Yasumasa Morimoto, Osaka (JP); Hironori Ogasawara, Osaka (JP); Toshiki Ohgita, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 16/578,290

(22) Filed: Sep. 21, 2019

(65) Prior Publication Data

US 2020/0017323 A1 Jan. 16, 2020

Related U.S. Application Data

(63) Continuation of application No. 15/995,296, filed on Jun. 1, 2018, now Pat. No. 10,450,155, which is a (Continued)

(30) Foreign Application Priority Data

Oct. 14, 2015 (JP) ..... 2015-202556
Aug. 25, 2016 (JP) ..... 2016-164259

(51) Int. Cl.
*B65H 3/52* (2006.01)
*G03G 15/00* (2006.01)
(Continued)

(52) U.S. Cl.
CPC ..... *B65H 3/5215* (2013.01); *B65H 1/04* (2013.01); *B65H 3/0669* (2013.01);
(Continued)

(58) Field of Classification Search
CPC ..... B65H 3/46; B65H 3/52; B65H 3/5207; B65H 3/5215; B65H 3/5223;
(Continued)

(56) References Cited

U.S. PATENT DOCUMENTS 5,921,539 A 7/1999 Westcott
7,401,774 B2 * 7/2008 Ginzton ..... B65H 3/5223 271/121

(Continued)

FOREIGN PATENT DOCUMENTS

JP H08-133511 A 5/1996
JP 2005-060091 3/2005
JP 2012-217147 A 11/2012

OTHER PUBLICATIONS

Allowed Claims from Parent U.S. Appl. No. 15/995,296, filed Jun. 1, 2018.

*Primary Examiner* — Prasad V Gokhale
(74) *Attorney, Agent, or Firm* — Renner, Otto, Boisselle & Sklar, LLP

(57) ABSTRACT

A sheet feed apparatus includes a sheet separation unit, and the sheet separation unit includes a separation roller that is provided so as to be brought into contact to an outer peripheral surface of a sheet feed roller, and separates a sheet fed by the sheet feed roller into one. The sheet separation unit comprises a hook for rotatably supporting the sheet separation unit in a main body casing of the sheet feed apparatus and an engaging claw that makes the sheet separation unit engage with the main body casing. Therefore, the sheet separation unit is held in the main body casing detachably.

11 Claims, 18 Drawing Sheets

Related U.S. Application Data continuation of application No. 15/290,116, filed on Oct. 11, 2016, now Pat. No. 10,011,445.

(51) Int. Cl.
*B65H 1/04* (2006.01)
*B65H 3/06* (2006.01)

(52) U.S. Cl.
CPC ..... *B65H 3/5223* (2013.01); *G03G 15/602* (2013.01); *G03G 15/6529* (2013.01); *B65H 2402/31* (2013.01); *B65H 2402/543* (2013.01); *B65H 2402/63* (2013.01); *B65H 2402/64* (2013.01); *B65H 2404/1341* (2013.01); *B65H 2601/324* (2013.01); *B65H 2801/06* (2013.01); *B65H 2801/39* (2013.01)

(58) Field of Classification Search
CPC .. B65H 3/5246; B65H 3/5253; B65H 3/5261; B65H 2402/31; B65H 2402/543; B65H 2402/5441; B65H 2402/63; B65H 2402/64; B65H 2404/1341; B65H 2601/324
See application file for complete search history.

(56) References Cited

U.S. PATENT DOCUMENTS

| | | | | |
|---|---|---|---|---|
| 8,695,964 | B2 * | 4/2014 | Hamaguchi | B65H 3/5223 271/121 |
| 9,278,822 | B2 * | 3/2016 | Suganuma | B65H 3/06 |
| 10,011,445 | B2 | 7/2018 | Suto | |
| 2002/0096819 | A1 * | 7/2002 | Fukasawa | B65H 3/5223 271/121 |
| 2008/0309000 | A1 * | 12/2008 | Tu | B65H 3/5223 271/109 |
| 2012/0043714 | A1 * | 2/2012 | Hamaguchi | B65H 3/5223 271/10.09 |
| 2012/0049438 | A1 * | 3/2012 | Akimatsu | B65H 3/5223 271/121 |
| 2012/0250115 | A1 | 10/2012 | Umeno | |
| 2014/0353905 | A1 * | 12/2014 | Takahata | B65H 3/5223 271/121 |
| 2015/0001787 | A1 * | 1/2015 | Tahara | B65H 5/062 271/117 |
| 2015/0183600 | A1 * | 7/2015 | Suganuma | B65H 3/0684 271/4.12 |
| 2016/0109841 | A1 * | 4/2016 | Horita | G03G 15/6511 399/388 |
| 2016/0221774 | A1 * | 8/2016 | Ohta | B65H 3/52 |

* cited by examiner

SHEET FEED APPARATUS AND IMAGE FORMING APPARATUS HAVING THE SAME

CROSS REFERENCE OF RELATED APPLICATION

This application is a continuation under 35 USC § 120 of U.S. application Ser. No. 15/995,296, filed Jun. 1, 2018, which is a continuation of U.S. application Ser. No. 15/290,116, filed Oct. 11, 2016 and now U.S. Pat. No. 10,011,445, the entire disclosures of which are incorporated herein by reference.

The disclosure of Japanese patent application Nos. 2015-202556 and 2016-164259 respectively filed on Oct. 14, 2015 and on Aug. 25, 2016 are incorporated by reference.

BACKGROUND OF THE INVENTION

Field of the Invention

The present invention relates to a sheet feed apparatus and an image forming apparatus having the same, and more specifically, a sheet feed apparatus that separates a sheet fed from a sheet placing tray and feeds the sheet one by one, and an image forming apparatus having the same.

Description of the Related Art

An example of a related art is disclosed in a Japanese patent application laying-open No. 2012-217147 [H04N 1/04] (Literature 1) laid-open on Nov. 8, 2012. A sheet feed apparatus disclosed in this literature 1 is a sheet feed apparatus that is applied to an image reading apparatus adopting a roller-separation system, which comprises a pickup roller for feeding a document sheet that is placed on a sheet feed tray, a sheet feed roller that is provided in a downstream side from the pickup roller in a sheet feeding direction and a separation roller for nipping the document sheet in cooperation with the sheet feed roller. In such a sheet feed apparatus, a document stacked on the tray is picked-up by the pickup roller and separated by the sheet feed roller and the separation roller one by one to be fed into a feeding path.

However, in such the sheet feed apparatus disclosed in this literature 1, since it is necessary to perform replacing work in a state where a cover of the sheet feed apparatus is opened when replacing a separation member like the separation roller, if installation structure of the separation member is complicated, it is hard to work. Therefore, there is a problem of dropping a removed component to an inside of the sheet feed apparatus at the time of the replacing work.

SUMMARY OF THE INVENTION

The present invention has been made in view of the above, and an object thereof is to provide a sheet feed apparatus capable of easily replacing a separation member and an image forming apparatus having the same.

A first invention is a sheet feed apparatus comprising: a sheet placing tray for placing sheets; a pickup roller that picks-up the sheets from the sheet placing tray; a sheet feed roller that is provided in a downstream side of the pickup roller in a sheet feeding direction and feeds the sheets picked-up by the pickup roller; and a sheet separation unit including a separation member such as a separation pad, a separation roller or the like, which is provided so as to be brought into contact to an outer peripheral surface of the sheet feed roller and separates the sheets fed by the sheet feed roller into one. The apparatus main body is a casing made of a synthetic resin, which forms an outer shell of the sheet feed apparatus. The sheet separation unit is held by a support portion that supports the sheet separation unit rotatably and an engaging portion that engages, by elastic deformation, the sheet separation unit. The support portion is provided in a downstream side from the engaging portion in the sheet feeding direction. Furthermore, by forming a projection on one of the sheet separation unit and the apparatus main body and by forming a hook that is engaged with the projection on the other thereof, for example, the sheet separation unit is supported rotatably on the apparatus main body. The engaging portion is formed with an engaging claw that is elastically deformed on one of the sheet separation unit and the apparatus main body and an engaging plate or the like with which the engaging claw is engaged on the other thereof, for example, and when the engaging claw is elastically deformed, the engaging portion makes the sheet separation unit engage with the apparatus main body.

According to the first invention, since the sheet separation unit including the separation member is detachably held on the apparatus main body, when replacing the separation member, it is possible to perform replacing work of the separation member at hand of a worker while easily removing the sheet separation unit from the apparatus main body. Therefore, it is possible to improve workability at the time of replacing the separation member.

A second invention is the sheet feed apparatus according to the first invention, wherein the support portion is provided in a downstream side from the separation member in the sheet feeding direction, and the engaging portion is provided in an upstream side from the separation member in the sheet feeding direction.

According to the second invention, since the support portion that supports the sheet separation unit onto the apparatus main body rotatably is provided in the downstream side of the sheet feeding direction from the separation member, it is possible to prevent a position of the separation member from shifting by impact when feeding the sheet between the sheet feed roller and the separation member. Thus, it is possible to bring the separation member into contact with the outer peripheral surface of the sheet feed roller stably, and thus, to stabilize separation performance.

A third invention is the sheet feed apparatus according to the first invention, wherein the engaging portion is provided in right and left of the separation member as viewed from the sheet feeding direction.

According to the third invention, the same effect as the first invention can be expected, and it is possible to improve workability at the time of replacing the separation member.

A fourth invention is the sheet feed apparatus according to the first invention, and further comprises a guide member that is provided so as to face the separation member in an upstream side from the separation member in the sheet feeding direction, and guides the sheets to a nip portion between the sheet feed roller and the separation member, wherein the engaging portion is provided outside a width of the guide member in a direction orthogonally intersecting the sheet feeding direction.

According to the fourth invention, by providing the guide member that guides the sheet to the nip portion between the sheet feed roller and the separation member, improvement of the separation performance can be expected. Furthermore, since the engaging portion is provided outside the guide member in the direction orthogonally intersecting the sheet feeding direction, it is possible to prevent attaching/detaching work of the sheet separation unit from being inhibited by the guide member.

A fifth invention is the sheet feed apparatus according to the first invention, and further comprises a guide member that is provided so as to face the separation member in an upstream side from the separation unit in the sheet feeding direction, and guides the sheets to a nip portion between the sheet feed roller and the separation member, wherein the engaging portion is provided inside a width of the guide member in a direction orthogonally intersecting the sheet feeding direction.

A sixth invention is the sheet feed apparatus according to the first invention, wherein the engaging portion is provided outside a width of the separation member in a direction orthogonally intersecting the sheet feeding direction.

A seventh invention is the sheet feed apparatus according to the first invention, wherein the engaging portion is provided inside a width of the separation member in a direction orthogonally intersecting the sheet feeding direction.

According to each of the fifth to seventh inventions, the same effect as the first invention can be expected, and it is possible to improve workability at the time of replacing the separation member.

An eighth invention is the sheet feed apparatus according to the first invention, wherein the separation member is a separation roller.

According to the eighth invention, since the sheet that is fed is separated by the separation roller being rotatable, it is possible to separate the sheet more stably.

A ninth invention is the sheet feed apparatus according to the eighth invention, and further comprises a torque limiter that is provided in a rotation axial direction of the separation roller and imposes a predetermined rotation load on the separation roller, wherein the engaging portion is arranged so as to face the torque limiter.

According to the ninth invention, since the rotation load of the separation roller can be adjusted by the torque limiter, it is possible to stabilize the separation performance and control a load torque applied to the sheet feed roller.

A tenth invention is an image forming apparatus comprising the sheet feed apparatus of the first invention.

According to the tenth invention, the same effect as the first invention can be expected, and it is possible to improve workability at the time of replacing the separation member.

An eleventh invention is a sheet feed apparatus comprising: a sheet placing tray for placing sheets; a pickup roller that picks-up the sheets from the sheet placing tray; a sheet feed roller that is provided in a downstream side of the pickup roller in a sheet feeding direction and feeds the sheets picked-up by the pickup roller; and a sheet separation unit including a separation member such as a separation pad, a separation roller or the like, which is provided so as to be brought into contact to an outer peripheral surface of the sheet feed roller and separates the sheets fed by the sheet feed roller into one. The apparatus main body is a casing made of a synthetic resin, which forms an outer shell of the sheet feed apparatus. The sheet separation unit is held by a support portion that supports the sheet separation unit rotatably and an engaging portion that engages, by elastic deformation, the sheet separation unit. The support portion is provided in an upstream side from the engaging portion in the sheet feeding direction. Furthermore, by forming a projection on one of the sheet separation unit and the apparatus main body and a hook that is engaged with the projection on the other thereof, for example, the sheet separation unit is supported rotatably on the apparatus main body. The engaging portion is formed with an engaging claw that is elastically deformed on one of the sheet separation unit and the apparatus main body and an engaging plate or the like that is engaged with the engaging claw on the other thereof, for example, and when the engaging claw is elastically deformed, the engaging portion makes the sheet separation unit engage with the apparatus main body.

According to the eleventh invention, since the sheet separation unit including the separation member is held on the apparatus main body detachably, when replacing the separation member, it is possible to perform replacing work of the separation member at hand of a worker while removing the sheet separation unit from the apparatus main body. Therefore, it is possible to improve workability at the time of replacing the separation member.

A twelfth invention is the sheet feed apparatus according to the eleventh invention, wherein the support portion is provided in an upstream side from the separation member in the sheet feeding direction, and the engaging portion is provided in a downstream side from the separation member in the sheet feeding direction.

According to the twelfth invention, since the sheet separation unit is held onto the apparatus main body detachably, when replacing the separation member, it is possible to perform replacing work of the separation member at hand of a worker while removing the sheet separation unit from the apparatus main body. Therefore, it is possible to improve workability at the time of replacing the separation member.

A thirteenth invention is the sheet feed apparatus according to the eleventh invention, wherein the engaging portion is provided in right and left of the separation member as viewed from the sheet feeding direction.

According to the thirteenth invention, the same effect as the eleventh invention can be expected, and it is possible to improve workability at the time of replacing the separation member.

A fourteenth invention is the sheet feed apparatus according to the eleventh invention, and further comprises a guide member that is provided so as to face the separation member in an upstream side from the separation unit in the sheet feeding direction, and guides the sheets to a nip portion between the sheet feed roller and the separation member, wherein the engaging portion is provided outside a width of the guide member in a direction orthogonally intersecting the sheet feeding direction.

According to the fourteenth invention, by providing the guide member that guides the sheet to the nip portion between the sheet feed roller and the separation member, improvement of the separation performance can be expected. Furthermore, since the engaging portion is provided outside a width of the guide member in the direction orthogonally intersecting the sheet feeding direction, it is possible to prevent attaching/detaching work of the sheet separation unit from being inhibited by the guide member.

A fifteenth invention is the sheet feed apparatus according to the eleventh invention, and further comprises a guide member that is provided so as to face the separation member in an upstream side from the separation unit in the sheet feeding direction, and guides the sheets to a nip portion between the sheet feed roller and the separation member, wherein the engaging portion is provided inside a width of the guide member in a direction orthogonally intersecting the sheet feeding direction.

A sixteenth invention is the sheet feed apparatus according to the fourteenth invention, wherein the sheet separation unit includes the guide member.

A seventeenth invention is the sheet feed apparatus according to the sixteenth invention, wherein the sheet separation unit includes a holder having the separation member, the support portion and the engaging portion, and the guide member is provided on the holder.

An eighteenth invention is the sheet feed apparatus according to the eleventh invention, wherein the engaging portion is provided outside a width of the separation member in a direction orthogonally intersecting the sheet feeding direction.

A nineteenth invention is the sheet feed apparatus according to the eleventh invention, wherein the engaging portion is provided inside a width of the separation member in a direction orthogonally intersecting the sheet feeding direction.

According to each of the fifteenth to nineteenth inventions, the same effect as the eleventh invention can be expected, and it is possible to improve workability at the time of replacing the separation member.

A twentieth invention is the sheet feed apparatus according to the eleventh invention, wherein the separation member is a separation roller.

According to the twentieth invention, since the sheet that is fed is separated by the separation roller being rotatable, it is possible to separate the sheet more stably.

A twenty-first invention is the sheet feed apparatus according to the twentieth invention, and further comprises a torque limiter that is provided in a rotation axial direction of the separation roller and imposes a predetermined rotation load on the separation roller, wherein the engaging portion is arranged so as to face the torque limiter.

According to the twenty-first invention, since the rotation load of the separation roller can be adjusted by the torque limiter, it is possible to stabilize the separation performance and control a load torque applied to the sheet feed roller.

A twenty-second invention is an image forming apparatus comprising the sheet feed apparatus of the eleventh invention.

According to the twenty-second invention, the same effect as the eleventh invention can be expected, and it is possible to intend to increase workability at the time of replacing the separation member.

The above mentioned objects and other objects, features, aspects and advantages of the present invention will become more apparent from the following detailed description of the present invention when taken in conjunction with the accompanying drawings.

BRIEF DESCRIPTION OF THE DRAWINGS

FIGS. 4(A)-4(B) show illustration views of junction structure of a separation roller and a torque limiter, wherein FIG. 4(A) shows a case where the separation roller and the torque limiter are viewed from the front, and FIG. 4(B) shows a junction portion of the separation roller and the torque limiter is viewed from an axial direction.

FIG. 6(A)-6(B) show illustration views of structure and a method of attaching the sheet separation unit, wherein FIG. 6(A) shows a state before attaching the sheet separation unit to a main body casing, and FIG. 6(B) shows a state after attaching the sheet separation unit to the main body casing.

DETAILED DESCRIPTION OF NON-LIMITING EXAMPLE EMBODIMENTS

First Embodiment

Figure 1:
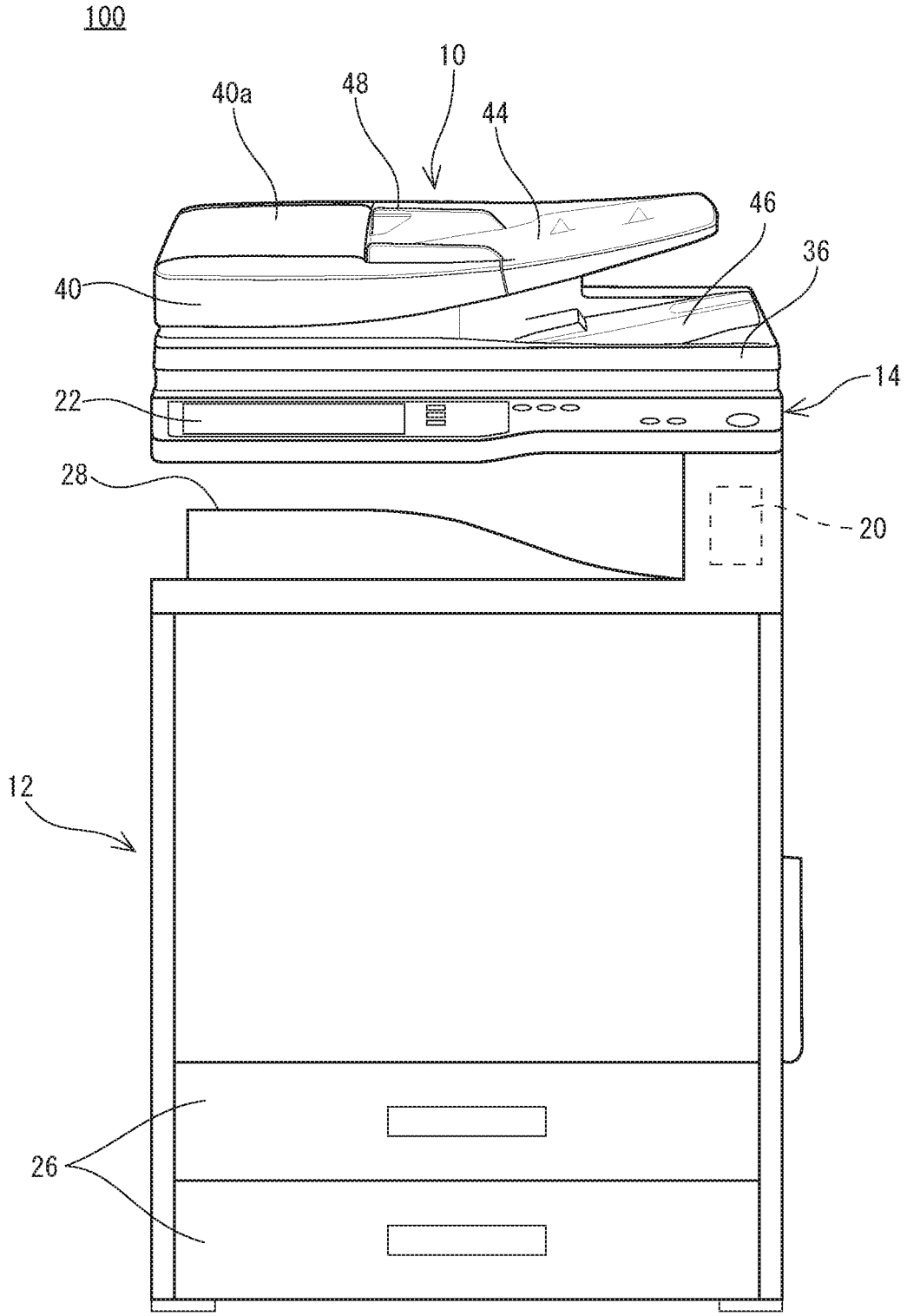
FIG. 1 is an illustration view showing an example of an appearance configuration of an image forming apparatus comprising a sheet feed apparatus that is a first embodiment according to the present invention.
Figure 2:
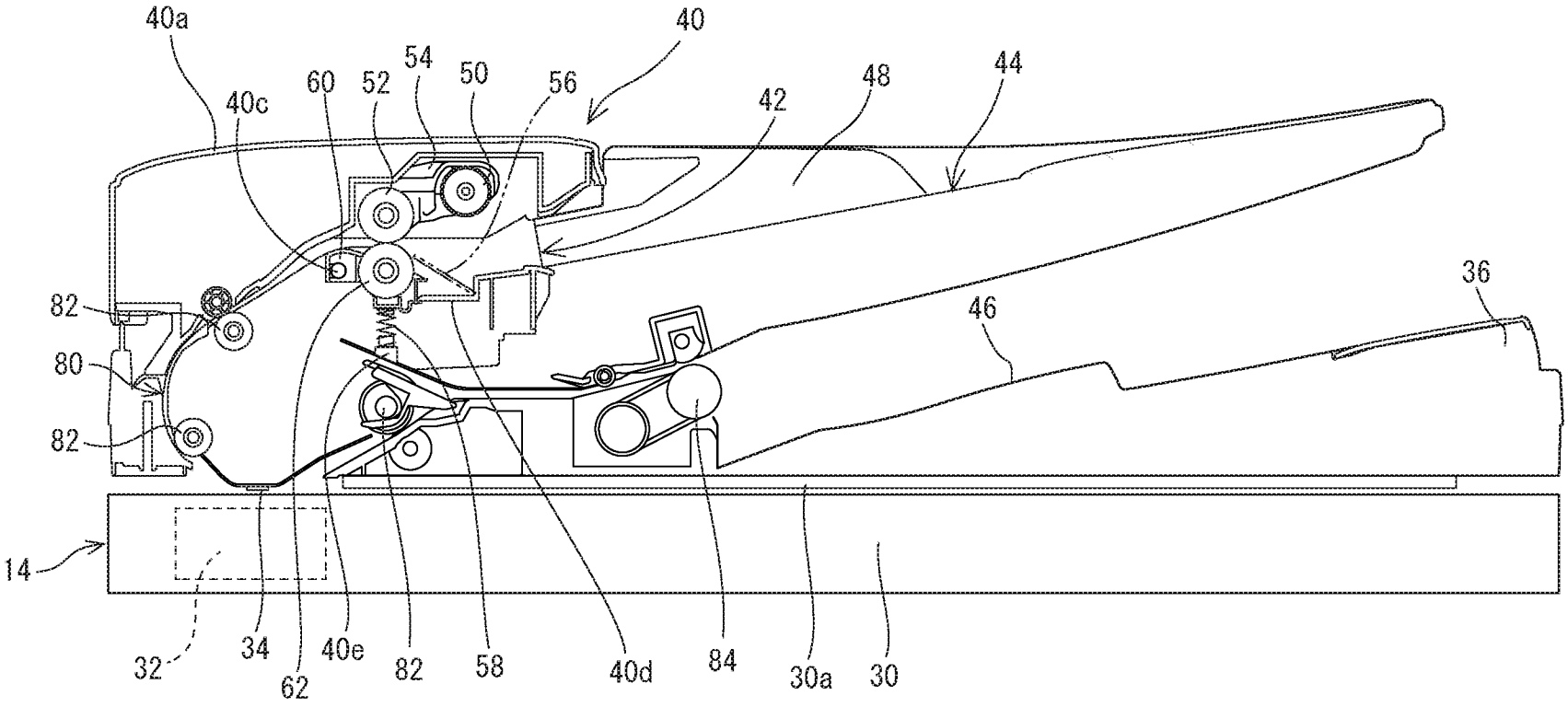
FIG. 2 is a schematic sectional view showing internal structure of the sheet feed apparatus.

FIG. 1 is an illustration view showing an example of an appearance configuration of an image forming apparatus 100 comprising a sheet feed apparatus 10 that is a first embodiment according to the present invention. FIG. 2 is a schematic sectional view showing internal structure of the sheet feed apparatus.

With reference to FIG. 1 and FIG. 2, the sheet feed apparatus 10 that is an embodiment of the present invention is used in the image forming apparatus 100 such as a copying machine, a facsimile, a printer, a multifunction peripheral combining them, etc. As details will be described later, the sheet feed apparatus 10 comprises a sheet feed roller 52, a sheet separation unit 60, etc., and feeds a document (sheet) placed on a document placing tray (sheet placing tray) 44 to an image reading position 34 one by one. This embodiment shows an example that the sheet feed apparatus 10 is applied to the image forming apparatus (multifunction peripheral) 100 combining a copying function, a printer function, a scanner function, a facsimile function, etc.

First, structure of the image forming apparatus 100 will be schematically described. As shown in FIG. 1 and FIG. 2, the image forming apparatus 100 comprises the sheet feed apparatus 10, an apparatus main body 12 and an image reading apparatus 14. A control portion 20 that controls an operation of each component or portion of the image forming apparatus 100 is provided in a predetermined position in the apparatus main body 12. The control portion 20 comprises a CPU, a memory, etc., and transmits a control signal to each component or portion of the image forming apparatus 100 according to an input operation to an operation portion 22 including a touch panel, operation buttons, etc., and makes the image forming apparatus 100 perform various operations.

Furthermore, an image forming portion comprising a photoreceptor drum, a charging device, an exposure device, a developing device, a transfer device, a fixing device, etc. is incorporated within the apparatus main body 12. The image forming portion forms an image with an electrophotographic system on a recording sheet that is fed from a sheet feeding cassette 26 or the like, and discharges the recording sheet that is formed with the image on a discharge tray 28. As image data for forming an image on the recording sheet, image data that is read by an image reading portion 32 of the image reading apparatus 14, image data that is transmitted by an external computer, etc. are used.

The image reading portion 14 comprises a housing 30 that has a document placing table 30*a* formed of transparent material on its upper surface. In this housing 30, the image reading portion 32 comprising a light source, a plurality of mirrors, a focusing lens, a line sensor, etc. is provided. The image reading portion 32 exposes a document surface by the light source, and leads a reflection light reflected from the document surface to the focusing lens by the plurality of mirrors. Then, the reflection light is focused onto light receiving elements of the line sensor. In the line sensor, the brightness and chromaticity of the reflection light that is focused on the light receiving elements are detected, and image data based on the image in the document surface is produced. As the line sensor, a CCD (Charge Coupled Device) or a CIS (Contact Image Sensor) is used.

In addition, the image reading portion 32 has a home position that is a position facing the image reading position 34, and when reading an image of the document that is placed on a document placing tray 44, the image reading portion 32 reads the image of the document surface at the time that the document that is fed from the sheet feed apparatus 10 passes through the image reading position 34, thereby to acquire the image data. Furthermore, when reading an image of a document that is placed on the document placing table 30*a* on an upper surface of the housing 30, the light source, the mirrors, etc. are appropriately moved beneath the document placing table 30*a* so as to read an image on the document surface, thereby to obtain image data.

Furthermore, a document cover 36 is attached, in a openable and closable manner, to the upper surface of the image reading apparatus 14 via a hinge. Then, the sheet feed apparatus 10 is provided on the document cover 36.

In the following, structure of the sheet feed apparatus 10 specifically. In addition, the term "upstream" or "downstream" in this specification means "upstream" or "downstream" in a document feeding direction (sheet feeding direction).

As shown in FIG. 2, the sheet feed apparatus 10 of this first embodiment is an automatic document feeder (ADF) that continuously feeds a document sheet that an image is to be read on a sheet discharge tray 46 via the image reading position 34 from the document placing tray 44. Furthermore, the sheet feed apparatus 10 comprises a main body casing 40 that is made of a synthetic resin and forms an outer shell. Then, within the main body casing 40, there is formed with a document feeding path 80 that extends from a feed port 42 to a discharge port that is opened with facing the sheet discharge tray 46 via the image reading position 34.

The feed port 42 is formed in an upper part of the main body casing 40. The document placing tray 44 is formed so as to be extended obliquely upward from this feed port 42. Furthermore, a plate-like top cover 40*a* is provided on a top part of the main body casing 10 so as to cover the top part of the feed port 42.

This top cover 40*a* is attached to the main body casing 40 in a manner that it is turnable upward. By turning the top cover 40*a* upward, an inside of the main body casing 40 is exposed. Furthermore, there are formed with a pair of side guides 48 movable in a width direction (a left-right direction as viewed from an upstream side of the document feeding direction) in an upper surface of the document placing tray 44. The side guides 48 regulate the document placed on the document placing tray 44 from both sides thereof in its width direction so as to align the document sheets.

In the main body casing 40, a pickup roller 50 that picks-up a document sheet placed on the document placing tray 44 is formed to be movable up and down. Furthermore, the sheet feed roller 52 is provided in a downstream side of the pickup roller 50, which sends the document picked-up from the document placing tray 44 by the pickup roller 50 to the document feeding path 80. A pickup holder 54 is provided so that an upper part and circumstances of these pickup rollers 50 and the sheet feed roller 52 can be covered. The pickup roller 50 is supported with this pickup holder 54 to be movable up and down around a rotation axis of the sheet feed roller 52.

Furthermore, a plurality of conveying rollers 82 and a sheet discharge roller 84 are formed in a downstream side of the sheet feed roller 52. The document sent to the document feeding path 80 by the sheet feed roller 52 is conveyed to the image reading position 34 with the plurality of conveying rollers 82. Then, an image is read by the image reading portion 32 of the image reading apparatus 14 while the document is conveyed above the image reading position 34. The document that is passed through the image reading position 34 is conveyed by the conveying rollers 82 and the sheet discharge roller 84, and discharged on the sheet discharge tray 46.

Moreover, there is provided with a separation roller 62 in a position facing the sheet feed roller 52, which separates the document sent by the sheet feed roller 52 in order to prevent multi-feed of the document. A nip portion is formed between the separation roller 62 and the sheet feed roller 52.

Furthermore, a guide member (guide sheet) 56 for guiding the document that is placed on the document placing tray 44 to the above-described nip portion is provided in an upstream side of the separation roller 62. This guide sheet 56 is made of a material having flexibility, and forms a shape of sheet. Furthermore, the guide sheet 56 is located in an upstream side from the separation roller 62 in the document feeding direction, and is provided on a straight line with this separation roller 62. Moreover, the guide sheet 56 is provided so as to slant upward as it goes to a downstream side.

In the sheet feed apparatus 10 comprising such the separation roller 62, performance of the separation roller 62 is reduced by aging due to wear etc. Therefore, there may occur replacing of the separation roller 62. In such a case, replacing work of the separation roller 62 is performed in a state where the inside of the main body casing 40 is exposed by turning the top cover 40*a* upward.

However, a range that the top cover 40*a* can be turned is restricted, and when performing the replacing work of the separation roller 62 in a narrow space and when the separation roller 62 is attached with comparatively complicated structure, it is hard to perform the replacing work. Therefore, there is an occasion of dropping a removed component etc. to an inside of the main body casing 40 at the time of the replacing work of the separation roller 62.

Therefore, in this first embodiment, by making the sheet separation unit 60 including the separation roller 62 in structure that is attachable to or detachable from the main body casing 40 from an exterior, it is possible to perform the replacing work of the separation roller 62 at hand of a worker while removing the sheet separation unit 60 from the main body casing 40.

Figure 3:
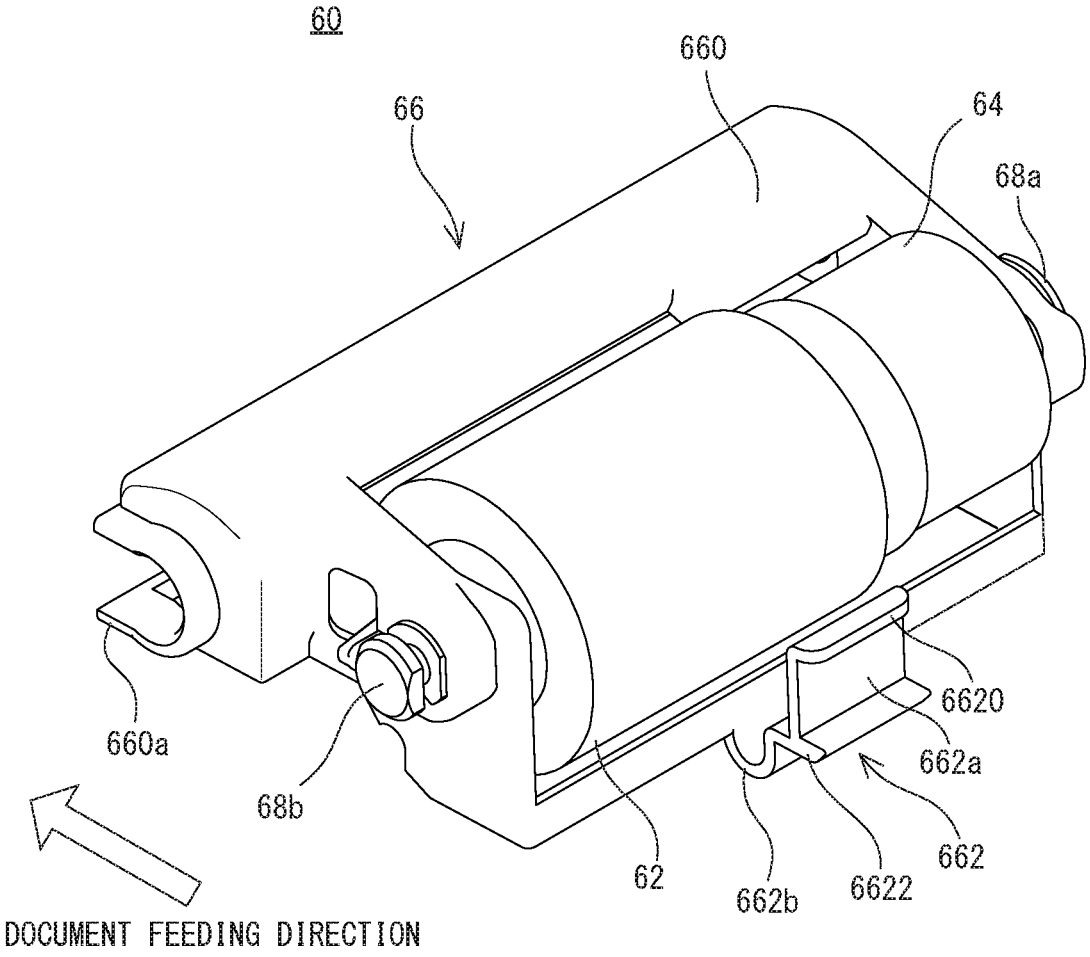
FIG. 3 is a perspective view showing an example of an appearance configuration of a sheet separation unit.

FIG. 3 is a perspective view showing an example of an appearance configuration of the sheet separation unit 60. In the following, the appearance configuration and an attaching method of the sheet separation unit 60 will be described specifically. As shown in FIG. 3, the sheet separation unit 60 includes the separation roller 62, a torque limiter 64, a holder 66, a bearing member 68*a*, a bearing member 68*b*, etc.

The separation roller 62 is a separation member formed of a material having a high friction coefficient, such as urethane resin etc. As shown in FIG. 2, this separation roller 62 is biased upward so as to be brought into contact with an outer peripheral surface of the sheet feed roller 52 with a predetermined pressure (separation pressure) by a compression spring 58. Furthermore, the separation roller 62 is set up in a manner that a friction coefficient between a surface thereof and a surface of the document sheet is smaller than a friction coefficient between the outer peripheral surface of the sheet feed roller 52 and the document sheet, and larger than a friction coefficient between respective document sheets.

The torque limiter 64 imposes a predetermined rotation load to the separation roller 62. This torque limiter 64 is provided in an axial direction of a rotation axis of the separation roller 62. More specifically, the torque limiter 64 is provided in a right side of the separation roller 62 as viewed from an upstream side in the document feeding direction. Furthermore, the torque limiter 64 is coupled to the separation roller 62 so that they can be rotated coaxially. Therefore, the separation roller 62 is not rotated if less than a predetermined torque.

Figure 4A:
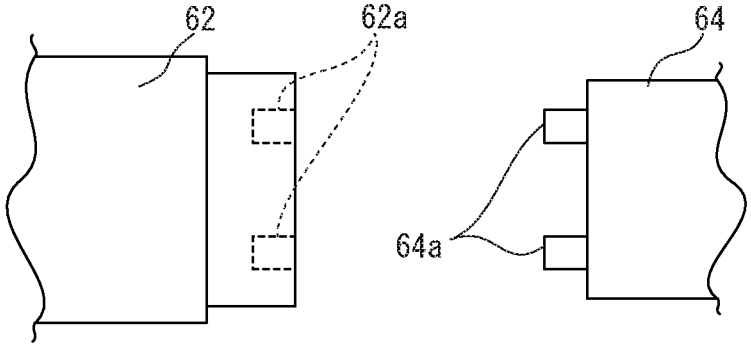
Figure 4:
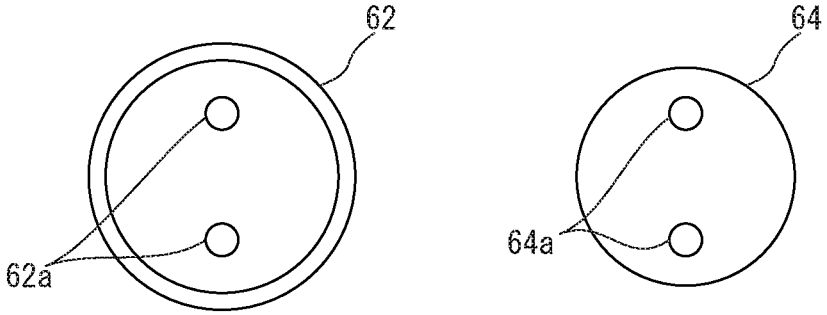

FIG. 4 is an illustration view for explaining junction structure of the separation roller 62 and the torque limiter 64. FIG. 4(A) shows a case where the separation roller 62 and the torque limiter 64 are viewed from the front, and FIG. 4(B) shows a junction portion of the separation roller 62 and the torque limiter 64 is viewed from the axial direction.

As shown in FIG. 4(A) and FIG. 4(B), there are formed with two cylindrical slots 62*a* each extending in an axial direction of the separation roller 62 in one end side surface (a right side end surface as viewed from the upstream side in the document feeding direction) of the separation roller 62. Furthermore, two cylindrical projections 64*a* each extended in an axial direction of the torque limiter 64 are formed in one end side surface (a left side end surface as viewed from the upstream side in the document feeding direction) of the torque limiter 64. One of the slots 62*a* and one of the projections 64*a* are formed in positions corresponding to each other. Similarly, the other of the slots 62*a* and the other of the projections 64*a* are formed in positions corresponding to each other. Furthermore, an inner diameter of each of the slots 62*a* is set up slightly larger than an outer diameter of each of the projections 64*a*. Therefore, the separation roller 62 and the torque limiter 64 can be joined to each other by fitting the slots 62*a* provided on the separation roller 62 and the projections 64*a* provided on the torque limiter 64 to each other.

In addition, junction structure of the separation roller 62 and the torque limiter 64 is not limited to the above-described one. For example, a projection(s) may be formed on a side of the separation roller 62, and a slot(s) may be formed on a side of the torque limiter 64. Furthermore, as long as a rotation force can be transmitted between the separation roller 62 and the torque limiter 64, shapes of the slots 62*a* and the projections 64*a* may be shapes other than a circle as viewed from the axial direction, such as a rectangle, a triangle, an elliptic, a shape obtained by combining them, etc. Furthermore, the slots 62*a* and the projections 64*a* may be formed three or more, respectively, and the slot 62*a* and the projection 64*a* may be formed only one, respectively if changing the shapes thereof as described above and being formed in a size (thickness) having a strength of a certain degree.

Returning to FIG. 3, the holder 66 (support member) is a member made of a synthetic resin. This holder 66 is attachable to or detachable from the main body casing 40 while holding (supporting) the separation roller 62 and the torque limiter 64 rotatably (turnably).

Here, holding structure of the separation roller 62 and the torque limiter 64 will be described. A first bearing portion (concave portion) is formed in the other end surface (a left end surface as viewed from the upstream side in the document feeding direction) of the separation roller 62. Furthermore, a second bearing portion (concave portion) is formed in the other end surface (a right end surface as viewed from the upstream side in the document feeding direction) of the torque limiter 64. However, the first bearing portion and the second bearing portion are formed coaxially.

On the other hand, the holder 66 is formed with a first communicating hole in a position corresponding to the first bearing portion on a left side as viewed from the upstream side in the document feeding direction and a second communicating hole in a position corresponding to the second bearing portion on a right side as viewed from the upstream side in the document feeding direction.

Then, a bearing member 68*a* is inserted, via the first communicating hold, into the first bearing portion from a left side surface (a left end surface as viewed from the upstream side in the document feeding direction) of the holder 66, and a bearing member 68*b* is inserted, via the second communicating hold, into the second bearing portion from a right side surface (a right end surface as viewed from the upstream side in the document feeding direction) of the holder 66. Therefore, the separation roller 62 and the torque limiter 64 are held (borne) on the holder 66 rotatably.

Although illustration and detailed description are omitted, the bearing member 68*a* and the bearing member 68*b* are respectively formed to be attachable to or detachable from the holder 66. Therefore, the separation roller 62 and the torque limiter 64 can be removed from the holder 66 by removing the bearing member 68*a* or the bearing member 68*b*. Then, as described above, since the separation roller 62 and the torque limiter 64 are joined to each other, it is possible to replace the separation roller 62 by releasing such junction.

Next, structure for attaching the holder 66 to the main body casing 40 will be described. In addition, an upstream side of the holder 66 means the upstream side in the document feeding direction in a state where it is attached to the main body casing 40, and a downstream side of the holder 66 means the downstream side in the document feeding direction in a state where it is attached to the main body casing 40.

The holder 66 includes a holder main body 660 and an engaging claw 662, and there is formed with a hook 660*a* for being engaged with the projection 40*c* (see FIG. 5) that is provided on the main body casing 40 in an end portion of the downstream side of the holder 66 (holder main body 660).

This hook 660*a* is a concave portion formed in a U-letter shape on each of left and right side surfaces when viewing the holder 66 from the upstream side in the document feeding direction. As shown also in FIG. 3, a part of a side wall of the concave portion is omitted (missed) so as to be opened toward the downstream side. That is, an opened part in the U-letter shape of the concave portion is formed to be turned toward the downstream side in the document feeding direction in a state where the holder 66 is attached to the main body casing 40. Although invisible in FIG. 3, a similar hook 660*a* is also formed on a right side surface when viewing the holder 66 from the upstream side of the document feeding direction.

Furthermore, the engaging claw 662 for being engaged with an engaging piece 40*d* (engaged portion) that is formed on the main body casing 40 in an end portion of the upstream side of the holder 66 (continued from a side surface in the upstream side). In this first embodiment, the engaging claw 662 is provided on an end portion in the upstream side of the holder 66 in a center or approximately center of the holder main body 660 in a left-right direction perpendicular to (orthogonally intersecting) the document feeding direction. That is, the engaging claw 662 is provided in a position aligned on a straight line with the separation roller 62 in the document feeding direction.

The engaging claw 662 includes an engaging portion 662*a* and a connecting portion 662*b*. The engaging portion 662*a* is a portion that is engaged with the above-described engaging piece 40*d*, and provided with a first claw portion 6620 that protrudes toward the upstream side in an upper end portion thereof and with a second claw portion 6622 that protrudes toward the upstream side in a lower end portion thereof. As described later, the engaging portion 662*a* is engaged with the engaging piece 40*d* between the first claw portion 6620 and the second claw portion 6622. The connecting portion 662*b* is a portion that connects the engaging portion 662*a* and the holder main body 660 to each other, and is formed in a U-letter shape as viewed from a left-right direction with respect to the document feeding direction. In this first embodiment, the connecting portion 662*b* is elastically deformable to the document feeding direction and vice versa. Therefore, the engaging portion 662*a* is tilted (moved) toward the upstream side and the downstream side in the document feeding direction.

Figure 5:
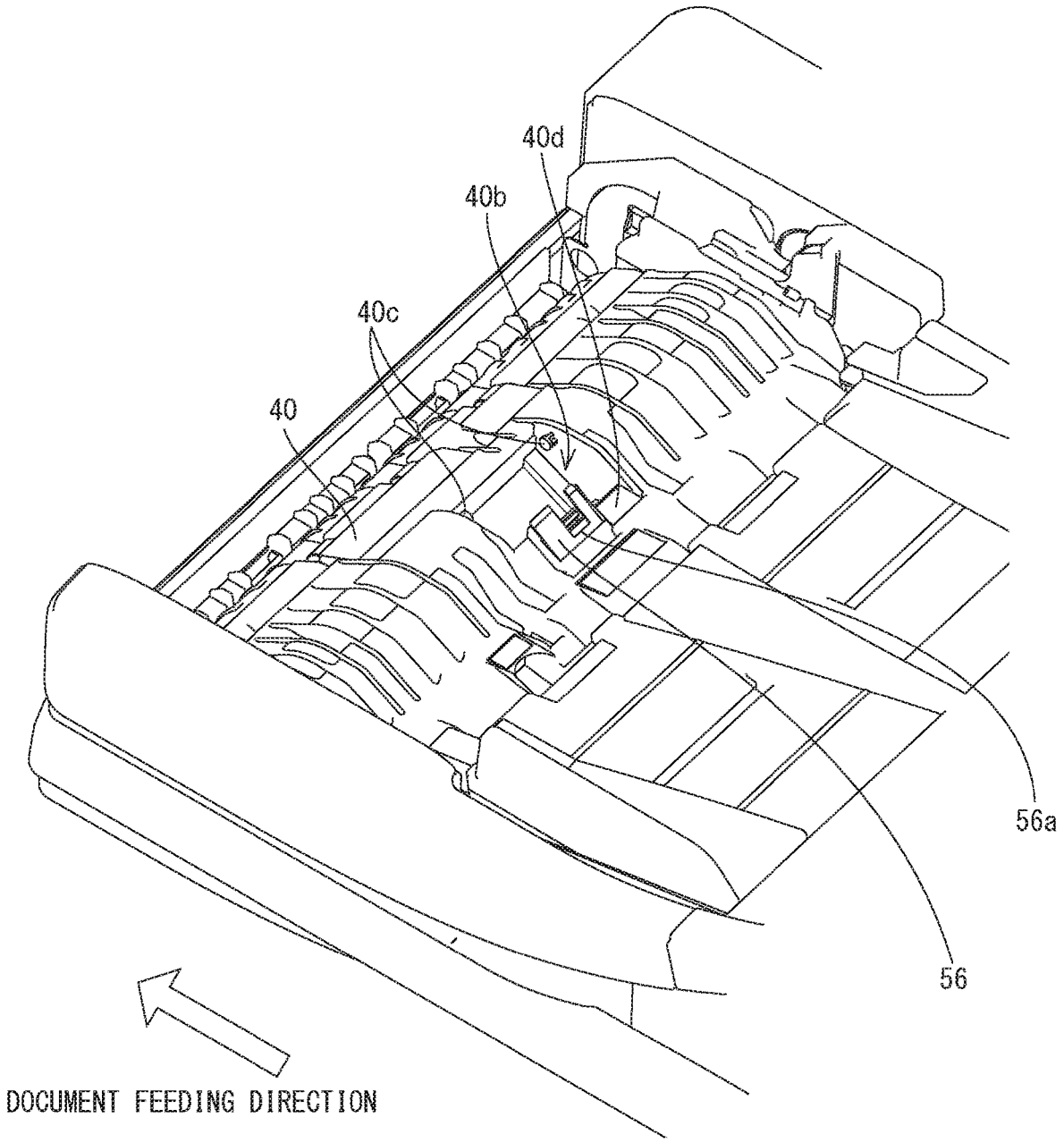
FIG. 5 is a schematic perspective view showing an appearance configuration of a part of the sheet feed apparatus in a state where the sheet separation unit is removed.
Figure 6:
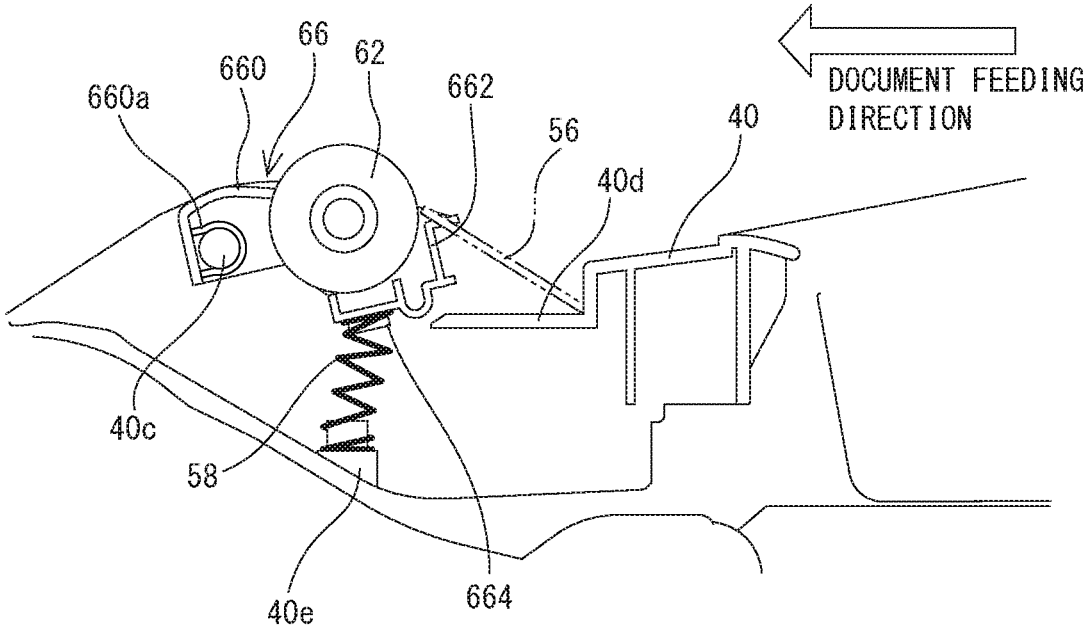
Figure 6:
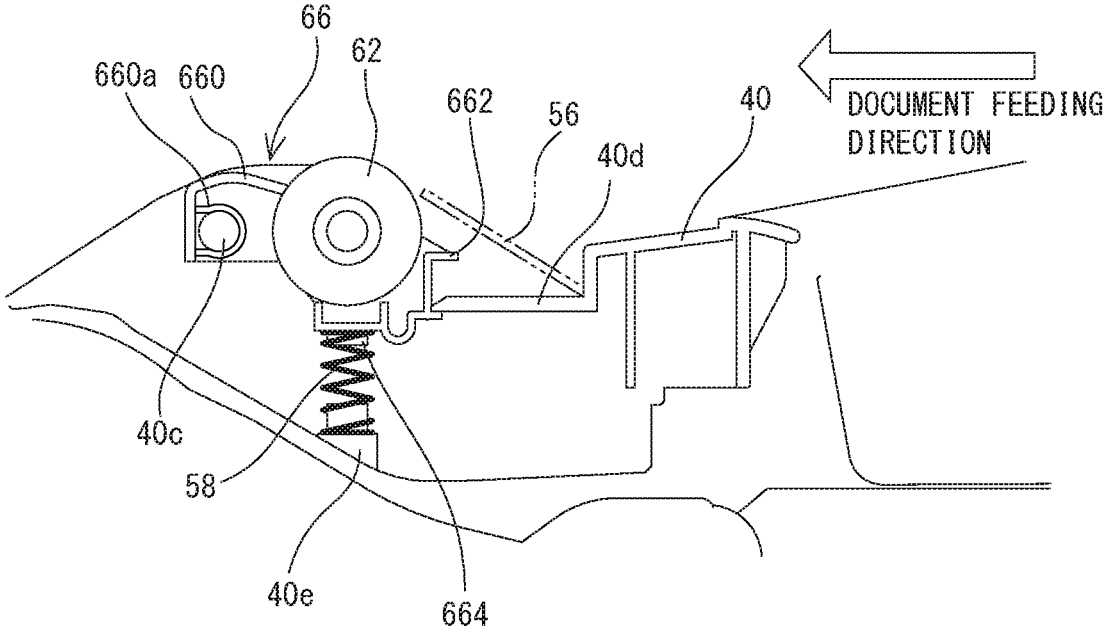
Figure 7:
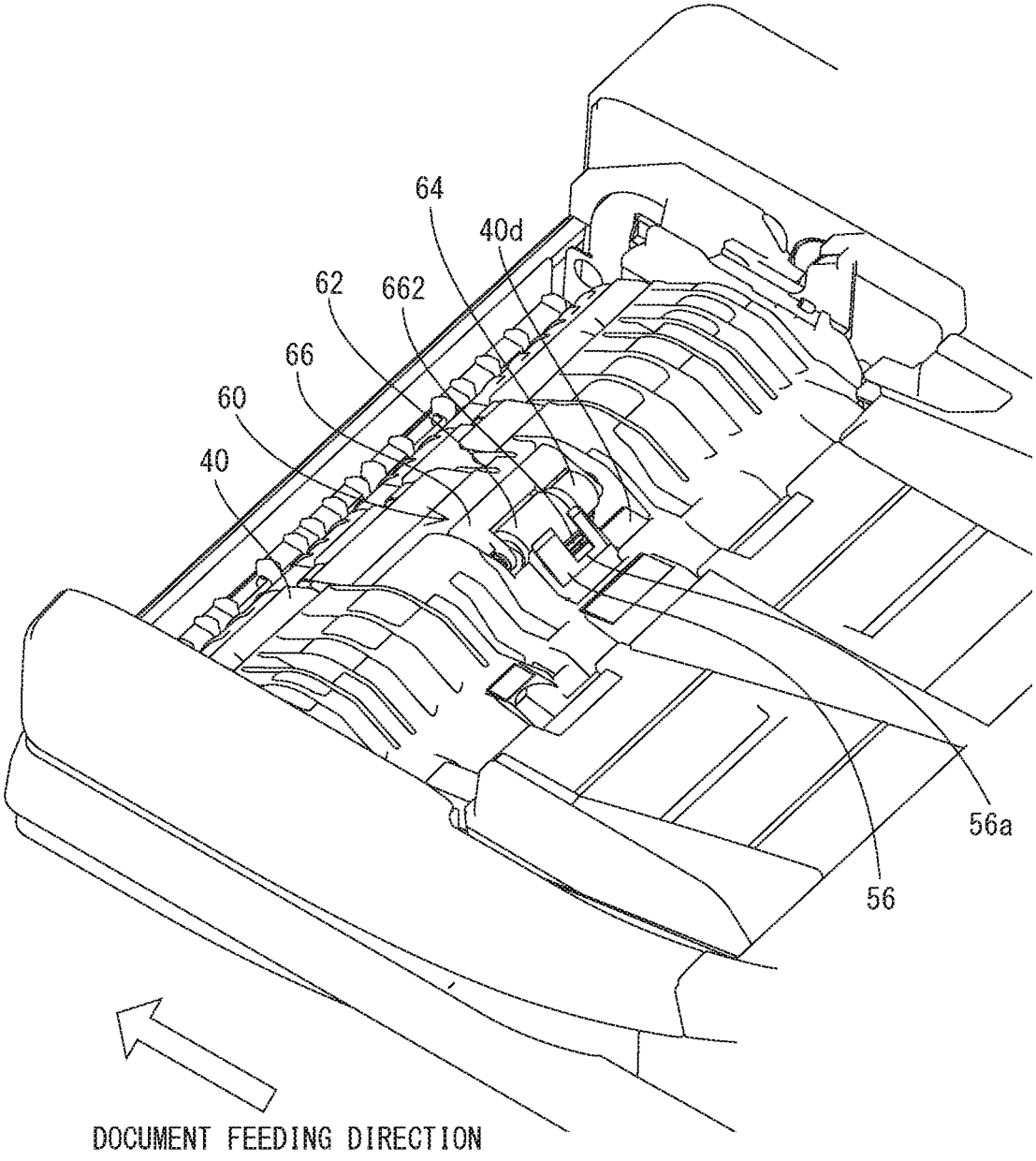
FIG. 7 is a schematic perspective view showing an appearance configuration of a part of the sheet feed apparatus in a state where the sheet separation unit is attached.

FIG. 5 is a schematic perspective view showing an appearance configuration of a part of the sheet feed apparatus 10 in a state where the sheet separation unit 60 is removed. FIG. 6 shows illustration views for explaining structure and a method of attaching the sheet separation unit 60, wherein FIG. 6(A) shows a state before attaching the sheet separation unit 60 to the main body casing 40, and FIG. 6(B) shows a state after attaching the sheet separation unit 60 to the main body casing 40. FIG. 7 is a schematic perspective view showing an appearance configuration of a part of the sheet feed apparatus 10 in a state where the sheet separation unit 60 is attached.

As shown in FIG. 5, FIG. 6(A) and FIG. 6(B), an accommodating portion 40*b* for accommodating the sheet separation unit 60 is formed in a center of the main body casing 40. In the downstream side of the accommodating portion 40*b*, there are formed with two projections 40*c* that protrude in the left-right direction as viewed from the upstream side in the document feeding direction. That is, the projection 40*c* is formed on each of a right side surface and a left side surface of an inner peripheral surface of the accommodating portion 40*b*. In addition, the two projections 40*c* are formed coaxially.

Furthermore, the engaging piece 40*d* with which the engaging claw 662 of the holder 66 is engaged is formed in the upstream side of the accommodating portion 40*b*. This engaging piece 40*d* is a part of the main body casing 40, and is formed in a plate shape. Furthermore, the engaging piece 40*d* has a width comparable as the accommodating portion 40*b* in a width direction of the document feeding direction.

When attaching the sheet separation unit 60 to the main body casing 40, the hook 660*a* is first hooked on the projection 40*c* from the opened portion of the concave portion. Subsequently, the sheet separation unit 60 is moved downward around the projection 40*c* as the rotation axis (turning axis), whereby the engaging claw 662 is engaged with the engaging piece 40*d*. At this time, since the connecting portion 662*b* is elastically deformed so that the opened portion of the U-letter shape becomes narrow, the engaging portion 662*a* is tilted toward the downstream side, and the sheet separation unit 60 is pushed-down in a state where the second claw portion 6622 is not brought into contact with the engaging piece 40*d*. Then, when the engaging piece 40*d* is located between the first claw portion 6620 and the second claw portion 6622, the connecting portion 662*b* is restored to its original state, and the engaging portion 662*a* is returned to its original position. Then, the engaging piece 40*d* is protruded from tip ends of the first claw portion 6620 and the second claw portion 6622 in a state where the sheet separation unit 60 (holder 66) is attached to the main body casing 40. That is, it is in a state where the engaging claw 662 is engaged with the engaging piece 40*d*.

Thus, when the sheet separation unit 60 is pushed-down in a state where the connecting portion 662*b* is restored (in a state where it is not deformed elastically), even if the sheet separation unit 60 is turned around the projection 40*c* as an axis, the engaging piece 40*d* is brought into contact with the first claw portion 6620, and a movement downward of the sheet separation unit 60 is regulated. Furthermore, when the sheet separation unit 60 is raised-up in a state where the connecting portion 662*b* is not deformed elastically, even if the sheet separation unit 60 is turned around the projection 40*c* as an axis, the engaging piece 40*d* is brought into contact with the second claw portion 6622, and a movement upward of the sheet separation unit 60 is regulated. Therefore, the sheet separation unit 60 is attached (held) onto the main body casing 40.

Furthermore, as described above, in a state where the holder 66 is attached to the main body casing 40, the hook 660*a* is constituted so that the concave portion thereof is opened toward the downstream side. Therefore, in a state where the holder 66 is attached to the main body casing 40, an upstream side of an outer peripheral surface of the projection 40*c* is brought into contact with the inner peripheral surface of the hook 660*a*. That is, a movement of the holder 66 toward the downstream side is regulated.

Furthermore, when the sheet separation unit 60 (holder 66) is raised-up while the engaging claw 662 is being pushed toward the downstream side in a state where the engaging claw 662 is engaged with the engaging piece 40*d*, the second claw portion 6622 is beyond the engaging piece 40*d*, whereby a state where the engaging claw 662 and the engaging piece 40*d* are engaged with each other can be released. Therefore, the sheet separation unit 60 (holder 66) can be removed from the main body casing 40.

Thus, since the sheet separation unit 60 can be attached to or detached from the main body casing 40 only by engaging the engaging claw 662 and the engaging piece 40*d* with each other or releasing such engagement, the sheet separation unit 60 can be attached or detached from the exterior easily if the top cover 40*a* is opened.

Moreover, as shown in FIG. 6(A) and FIG. 6(B), the compression spring 58 is provided between the sheet separation unit 60 and the main body casing 40. A spring mounting portion 664 is provided on an undersurface of the holder main body 660, and a spring mounting portion 40*e* is provided on a bottom surface of the accommodating portion 40*b* of the main body casing 40. Therefore, one end of the compression spring 58 is mounted (fitted) to the spring mounting portion 664, and the other end of the compression spring 58 is mounted to the spring mounting portion 40*e*. Accordingly, by an elastic force of the compression spring 58, the sheet separation unit 60 (holder 66) is pushed-up and the separation roller 62 is pressure-contacted to the sheet feed roller 52. Therefore, as described above, a nip portion is formed between the separation roller 62 and the sheet feed roller 52.

Furthermore, as shown in FIG. 7, a notch 56*a* is formed in the guide sheet 56 in a position corresponding to (facing) the engaging claw 662. When the sheet separation unit 60 is attached to the main body casing 40, the engaging claw 662 is exposed from the notch 56*a*. Therefore, it is possible for the worker to touch the engaging claw 662 through the notch 56*a* when attaching or detaching the sheet separation unit 60 to or from the main body casing 40. Although the notch 56*a* is formed in a concave form as shown in FIG. 7, the notch 56*a* may be formed in other forms as long as a finger of the worker can pass therethrough.

According to this first embodiment, since the sheet separation unit 60 including the separation roller 62 is constituted to be attachable to or detachable from the main body casing 40 from the exterior, in replacing the separation roller 62, it is possible to perform replacing work of the separation roller 62 at hand of the worker while removing the sheet separation unit 60 from the main body casing 40. Therefore, the separation roller 62 can be easily replaced.

Furthermore, according to this first embodiment, a movement of the sheet separation unit 60 toward the downstream side can be regulated because the projection 40*c* and the hook 660*a* that support the sheet separation unit 60 in the main body casing 40 rotatably are provided in the downstream side of the separation roller 62 and a movement of the holder 66 toward the downstream side is regulated when the inner peripheral surface of the hook 660*a* is brought into contact with the projection 40*c*. Therefore, it is possible to prevent a position of the separation roller 62 from shifting by impact when feeding the document sheet between the sheet feed roller 52 and the separation roller 62. That is, it is possible to stabilize separation performance since the separation roller is stably pressure-contacted with sheet feed roller 52.

Moreover, according to this first embodiment, since the holder 66 is supported from both sides of right and left by the two projections 40*c* of right and left, it is possible to prevent only one of a right portion and a left portion of the separation roller 62 from being worn.

In addition, although the hook 660*a* is provided on the holder 66 and the projection 40*c* is provided on the main body casing 40 in the first embodiment, the holder 66 may be provided with the projection(s) and the main body casing 40 may be provided with the hook(s) (support portion).

Furthermore, although the engaging claw 662 is provided on the holder 66 and the engaging piece 40*d* is provided on the main body casing 40 in the first embodiment, the engaging piece may be provided on the holder 66 and the engaging claw may be provided on the main body casing 40. In such a case, the engaging piece is provided so as to be extended toward the upstream side from the holder main body 660. On the other hand, the engaging claw is provided on the main body casing 40 so that an engaging portion can be engaged with the engaging piece provided on the holder main body 660. However, it is necessary to provide the engaging claw below from an upper surface of the guide sheet 56 so as not to interfere with conveyance of the sheet.

Second Embodiment

Since a sheet feed apparatus 10 of the second embodiment is the same as the sheet feed apparatus 10 of the first embodiment except that the engaging claw 662 formed on the holder 66 is provided outside a position (width) corresponding to the guide sheet 56, a duplicate description will be omitted or simplified. Furthermore, portions common to those in the above-described first embodiment will be described using the same reference numerals.

Figure 8:
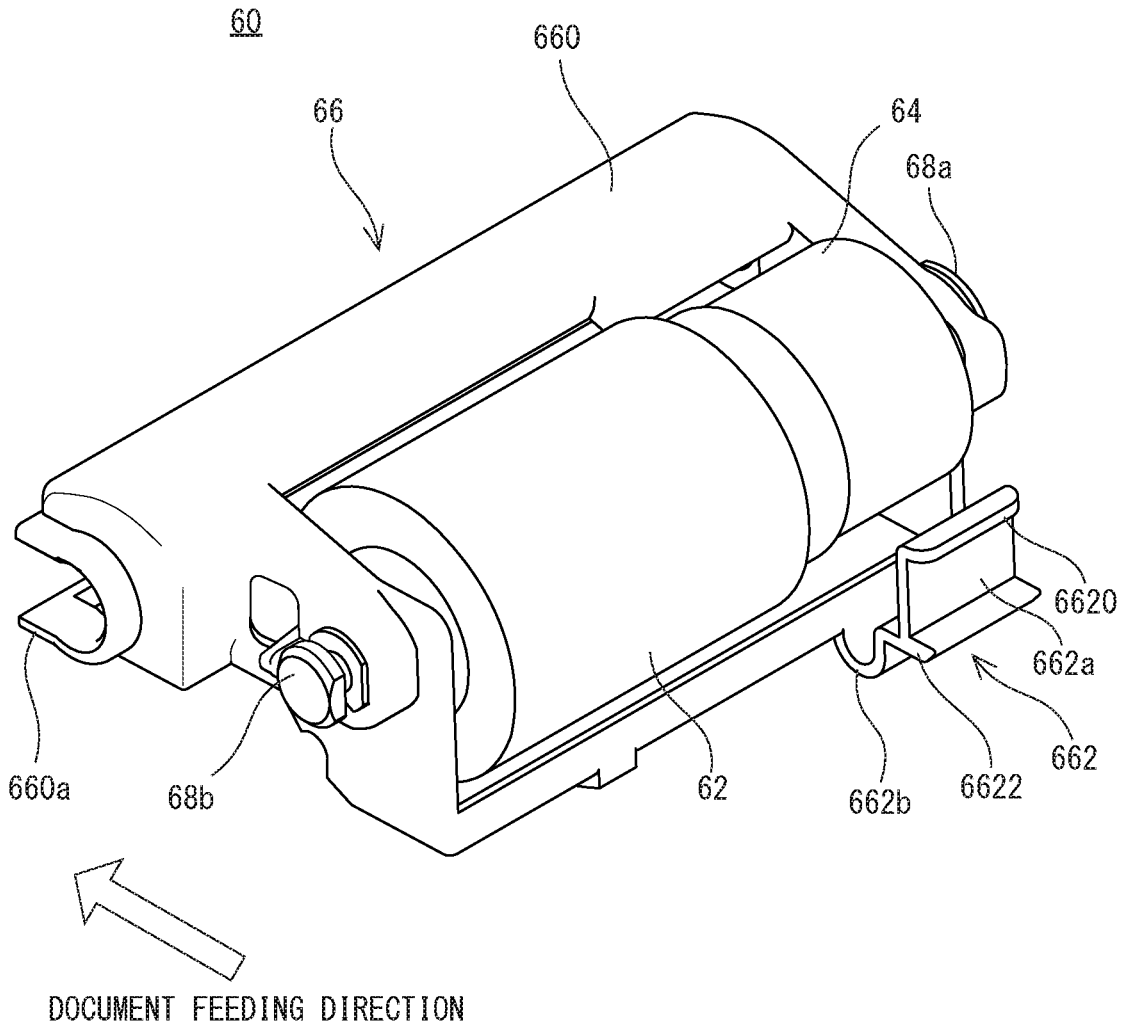
FIG. 8 is a perspective view showing an appearance configuration of a sheet separation unit in a second embodiment.
Figure 9:
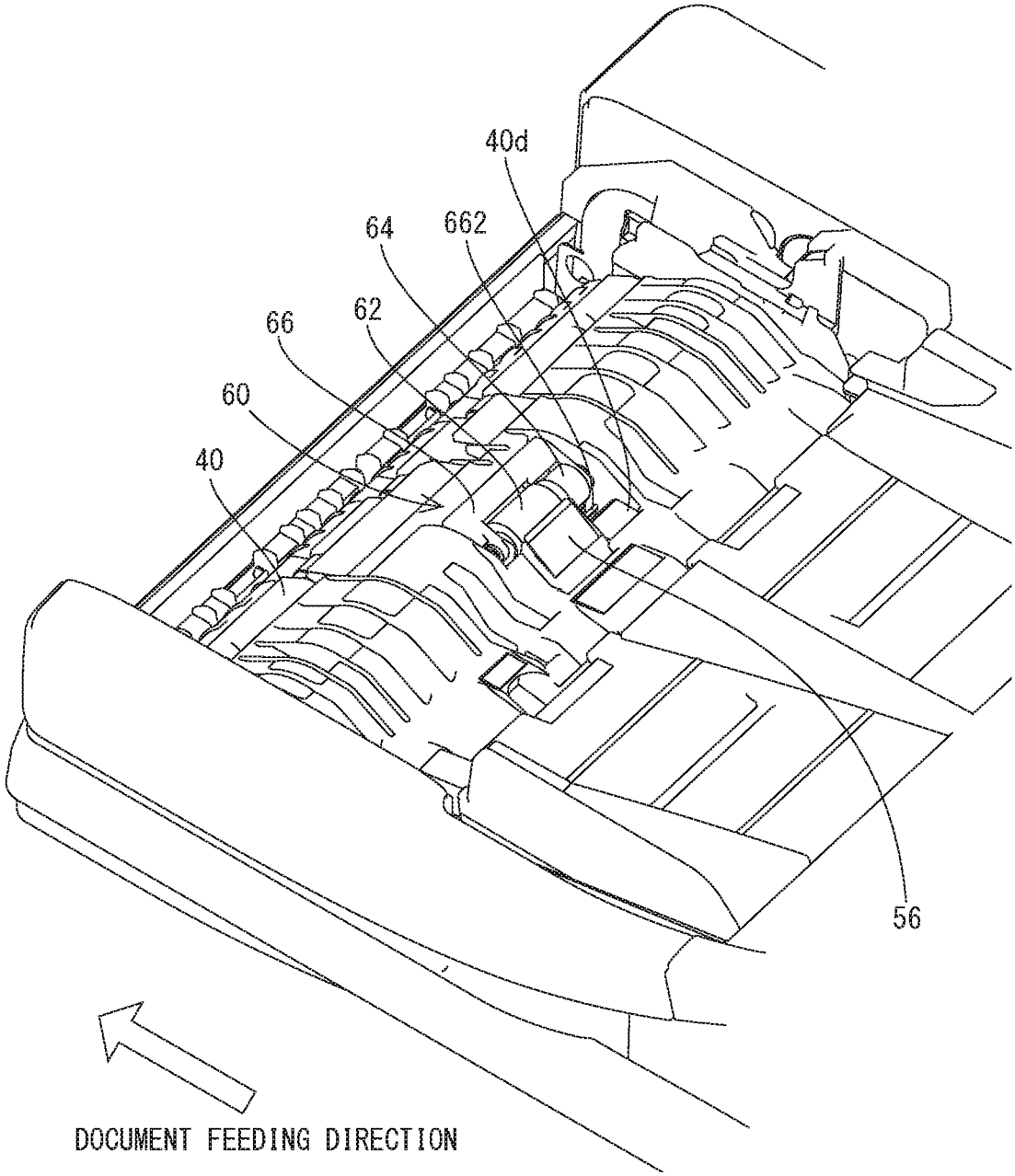
FIG. 9 is a perspective view showing a part of an appearance configuration of a sheet feed apparatus in the second embodiment.

FIG. 8 is a perspective view showing an appearance configuration of a sheet separation unit 60 in a second embodiment. FIG. 9 is a perspective view showing a part of an appearance configuration of the sheet feed apparatus 10 in the second embodiment.

As shown in FIG. 8 and FIG. 9, in the second embodiment, the engaging claw 662 is provided outside the position where guide sheet 56 is provided in the left-right direction as viewed from the upstream side of the document feeding direction. That is, the engaging claw 662 is provided in a position that does not overlap with the guide sheet 56 as viewed from the upstream side of the document feeding direction. Specifically, the engaging claw 662 is provided in a position corresponding to (facing) the torque limiter 64.

Furthermore, the guide sheet 56 is provided in a position corresponding to the separation roller 62; however, since the guide sheet 56 is not extended up to the position corresponding to the torque limiter 64, it is unnecessary to form the notch 56*a* like the first embodiment. Therefore, when the sheet separation unit 60 is attached to the main body casing 40, the engaging claw 662 is exposed beside the guide sheet 56.

According to this second embodiment, since the engaging claw 662 is provided outside the position corresponding to the guide sheet 56, and thus, there is no necessity that the notch 56*a* is provided in the guide sheet 56, improvement of the separation performance can be expected. Furthermore, since the engaging piece 40*d* and the engaging claw 662 are provided outside the guide sheet 56, it is possible to implement arrangement that the engaging claw 662 can be easily exposed, and therefore, attaching/detaching work of the sheet separation unit 60 becomes easy.

Third Embodiment

Since the third embodiment is the same as the first embodiment except that a separation pad 74 is used as the separation member instead of the separation roller 62, a duplicate description will be omitted or simplified. Furthermore, portions common to those in the above-described first embodiment will be described using the same reference numerals.

Figure 10:
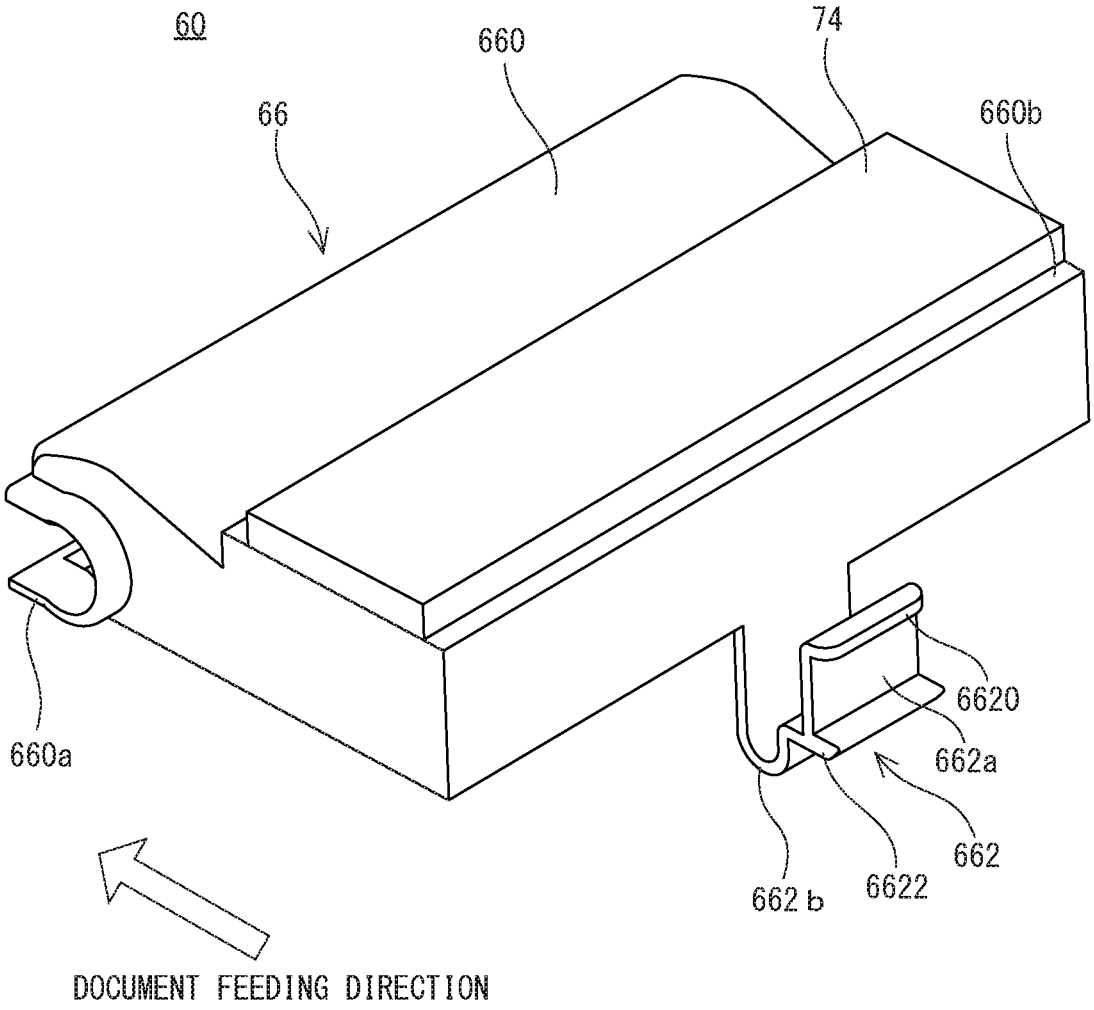
FIG. 10 is a perspective view showing an example of an appearance configuration of a sheet separation unit in a third embodiment.
Figure 11:
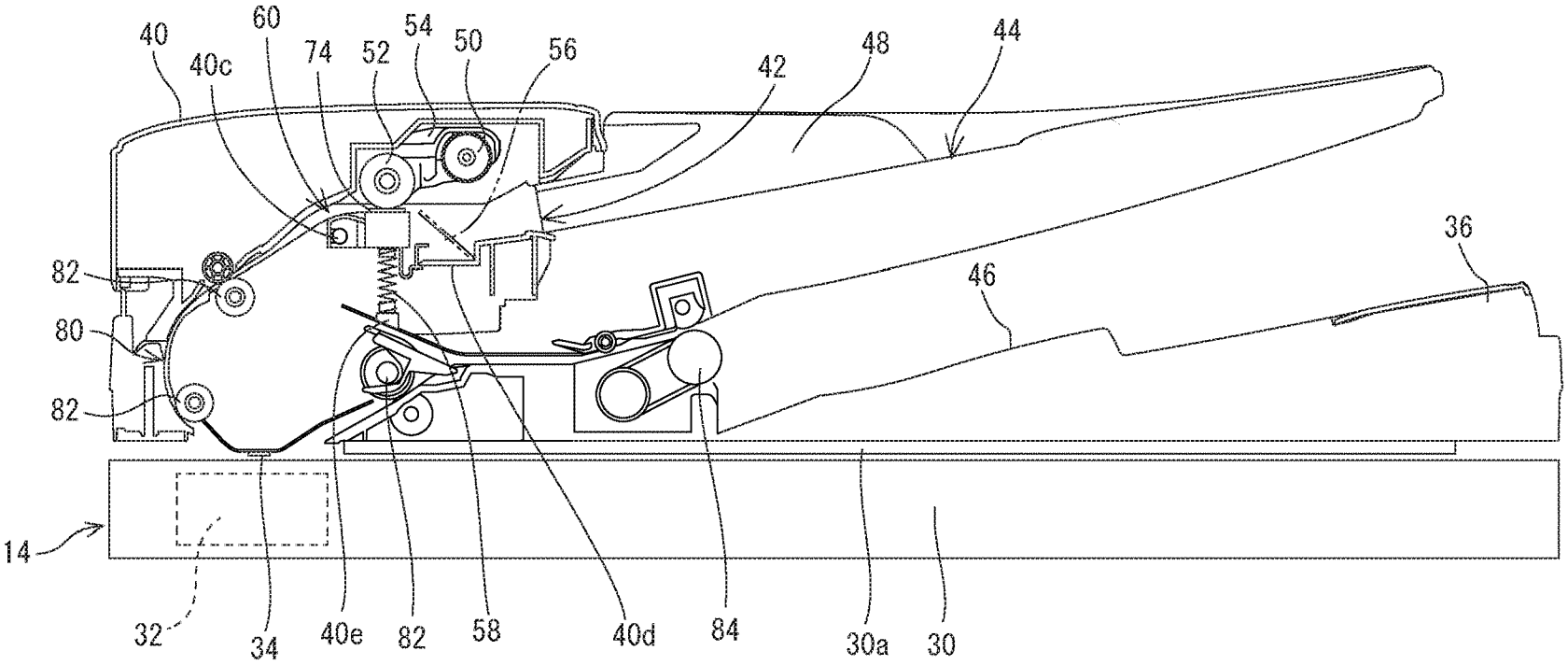
FIG. 11 is a schematic sectional view showing internal structure of a sheet feed apparatus in the third embodiment.

FIG. 10 is a perspective view showing an example of an appearance configuration of a sheet separation unit 60 in a third embodiment. FIG. 11 is a schematic sectional view showing internal structure of a sheet feed apparatus 10 in the third embodiment.

In the third embodiment, as shown in FIG. 10 and FIG. 11, the sheet separation unit 60 includes the separation pad 74.

The separation pad 74 is formed of material having a high friction coefficient, such as urethane resin etc. This separation pad 74 is a rectangular plate-like member. Furthermore, the separation pad 74 is supported by the holder 66.

The holder 66 is formed with a placing surface 660*b* on which the separation pad 74 is placed. This placing surface 660*b* is arranged so as to face the sheet feed roller 52. In addition, since the separation pad 74 is not rotated, in this third embodiment, the torque limiter 64, the bearing member 68*a* and the bearing member 68*b* are not provided.

Furthermore, the holder 66 is biased upward by the compression spring 58. That is, the separation pad 74 is biased so as to be brought into contact with the outer peripheral surface of the sheet feed roller 52 with a predetermined pressure. Therefore, a nip portion is formed between the separation pad 74 and the sheet feed roller 52.

Furthermore, the separation pad 74 is set up in a manner that a friction coefficient between a surface thereof and a surface of the document sheet is smaller than a friction coefficient between the outer peripheral surface of the sheet feed roller 52 and the document sheet and larger than a friction coefficient between respective document sheets. Accordingly, the document sheet is separated into one at the nip portion of the separation pad 74 and the sheet feed roller 52, and sent to the document feeding path 80 one by one.

In this third embodiment, since the separation pad 74 is used as a separation member, it is possible to simplify structure of the sheet separation unit 60, and to reduce the number of components and thus a manufacturing cost.

Furthermore, according to the third embodiment, it is possible to perform replacing work of the separation pad 74 at hand of the worker. Therefore, the separation pad 74 can be is easily replaced.

In addition, it is possible to adopt a configuration shown in the third embodiment in combination to the second embodiment.

Fourth Embodiment

Since a sheet feed apparatus 10 of the fourth embodiment is the same as the sheet feed apparatus 10 of the first embodiment except that a plurality of engaging claws 662 are formed, a duplicate description will be omitted or simplified. Furthermore, portions common to those in the above-described first embodiment will be described using the same reference numerals.

Figure 12:
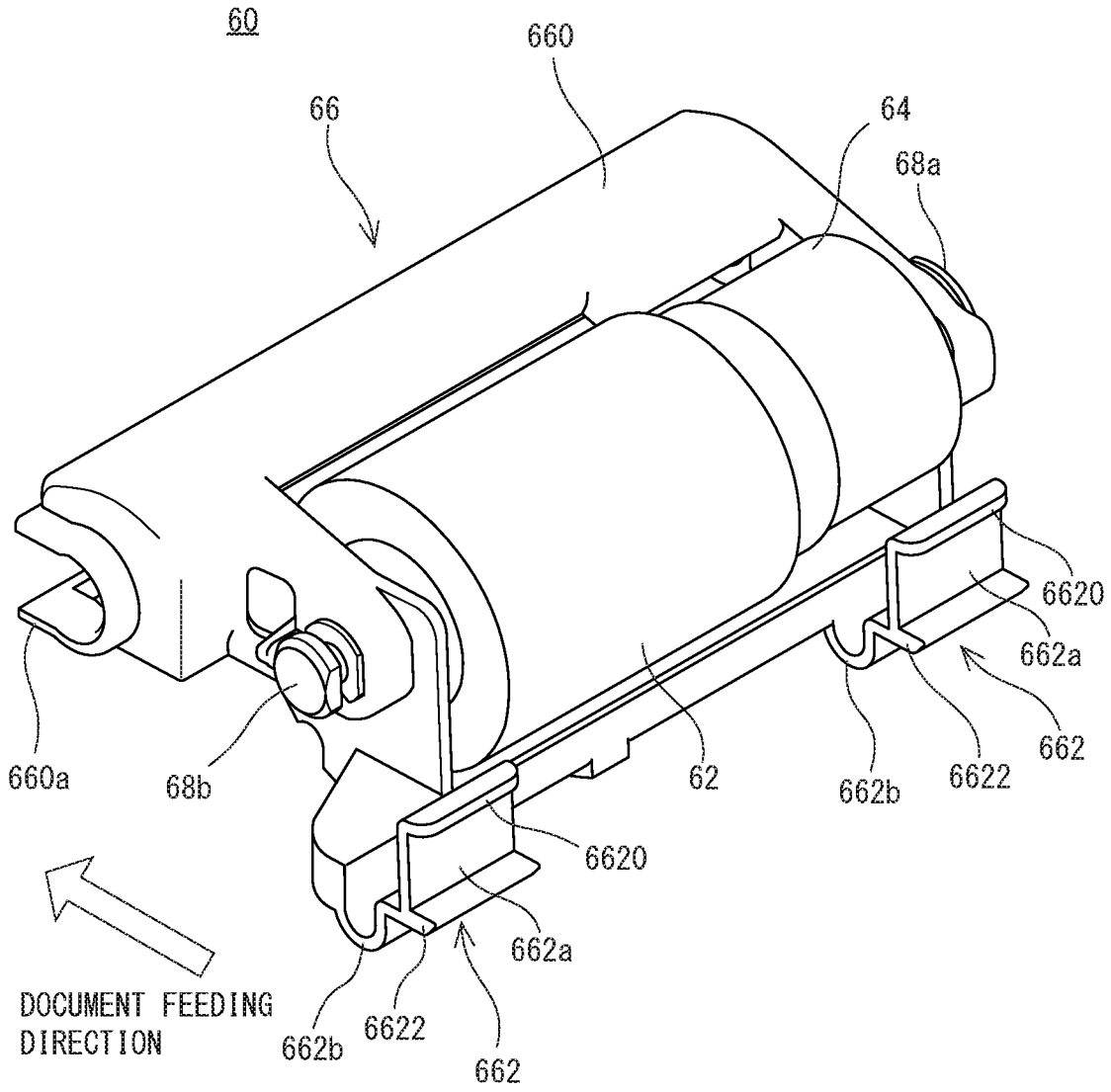
FIG. 12 is a perspective view showing an example of an appearance configuration of a sheet separation unit in a fourth embodiment.
Figure 13:
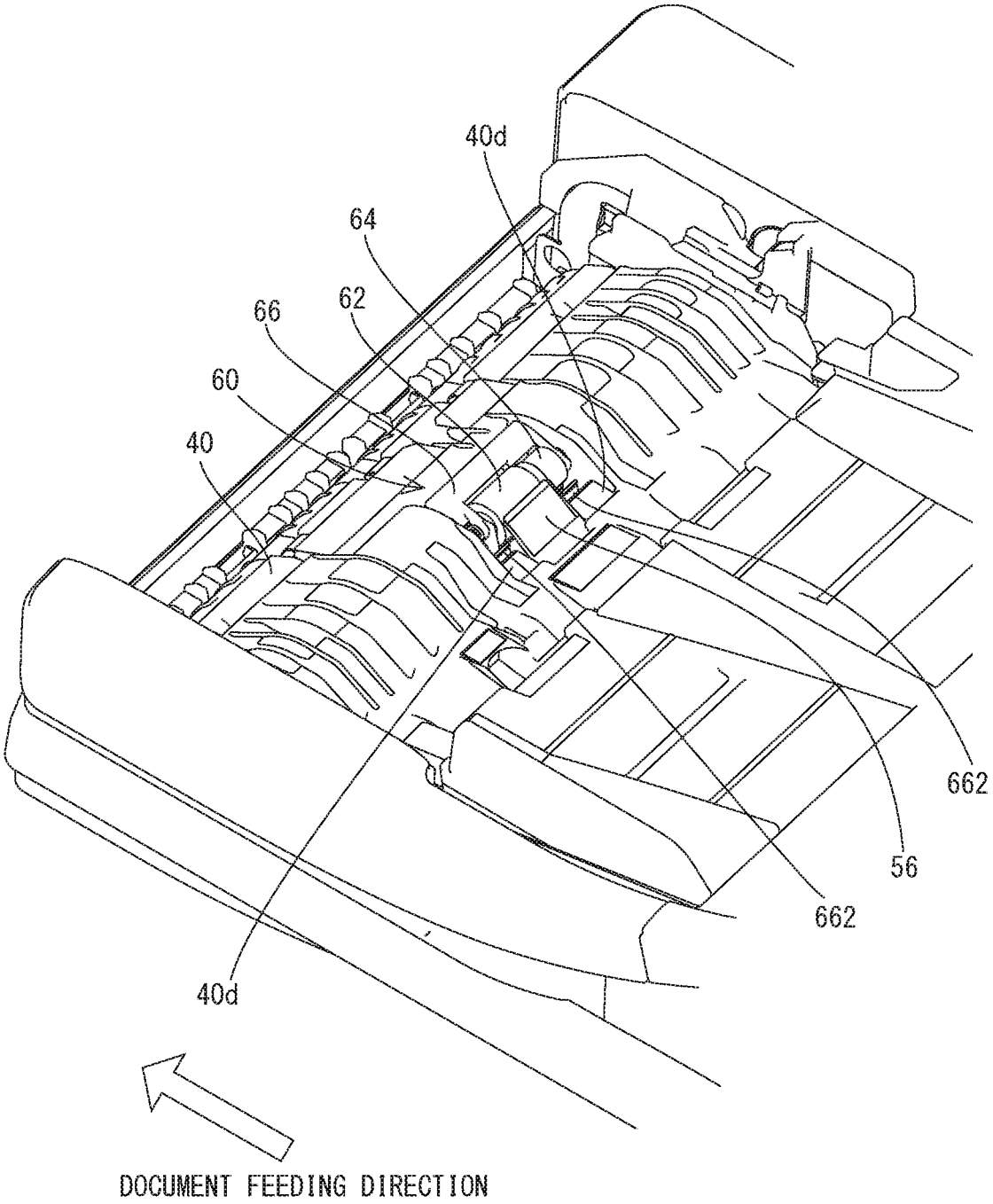
FIG. 13 is a perspective view showing an appearance configuration of a part of a sheet feed apparatus in the fourth embodiment.

FIG. 12 is a perspective view showing an example of an appearance configuration of a sheet separation unit 60 in the fourth embodiment. FIG. 13 is a perspective view showing an appearance configuration of a part of the sheet feed apparatus 10 in the fourth embodiment.

As shown in FIG. 12, two engaging claws 662 are formed on the holder 66 in the fourth embodiment. As shown in FIG. 13, the two engaging claws 662 are respectively provided outside the position (width) corresponding to the guide sheet 56 is provided in the left-right direction as viewed from the upstream side in the document feeding direction. That is, the two engaging claws 662 are provided in the positions not overlapping with the guide sheet 56 as viewed from the upstream side in the document feeding direction. Specifically, one engaging claw 662 is arranged on the right side of the guide sheet 56 as viewed from the upstream side in the document feeding direction, and is provided in a position corresponding to (facing) the torque limiter 64. The other engaging claw 662 is arranged on the left side of the guide sheet 56 as viewed from the upstream side in the document feeding direction. Furthermore, it can be said that the other engaging claw 662 is arranged outside the position (width) where the separation roller 62 is provided in the left-right direction as viewed from the upstream side in the document feeding direction.

Furthermore, as shown in FIG. 13, in the fourth embodiment, two engaging pieces 40*d* are provided on the main body casing 40. One engaging piece 40*d* is provided in a position corresponding to the one engaging claw 662, and the other engaging piece 40*d* is provided in a position corresponding to the other engaging claw 662.

If the sheet separation unit 60 is attached to the main body casing 40, the two engaging claws 662 are engaged with the engaging pieces 40*d*, respectively, and exposed in the right and left of the guide sheet 56, respectively. However, in the example shown in FIG. 13, since the two engaging claws 662 are provided outside the position where the guide sheet 56 is provided, the guide sheet 56 is not formed with the notch 56*a* as in the first embodiment.

According to also this fourth embodiment, since the sheet separation unit 60 including the separation roller 62 is constituted to be attachable to or detachable from the main body casing 40 from the exterior, in replacing the separation roller 62, it is possible to perform replacing work of the separation roller 62 at hand of the worker while easily removing the sheet separation unit 60 from the main body casing 40. Therefore, the separation roller 62 can be easily replaced.

In addition, it is possible to adopt a configuration shown in the fourth embodiment in combination to the second embodiment and/or the third embodiment.

Furthermore, although the two engaging claws 662 are provided in the fourth embodiment, there is no necessity of being limited to this, and three or more engaging claws 662 may be provided.

Moreover, there is no necessity that the positions of the two engaging claws 662 are limited to the positions described above, and the positions are changeable suitably.

Fifth Embodiment

Since a sheet feed apparatus 10 of the fifth embodiment is the same as the sheet feed apparatus 10 of the first embodiment except that the engaging claws 662 are formed on a left side surface and a right side surface of the holder 66, respectively, a duplicate description will be omitted or simplified. Furthermore, portions common to those in the above-described first embodiment will be described using the same reference numerals.

Figure 14:
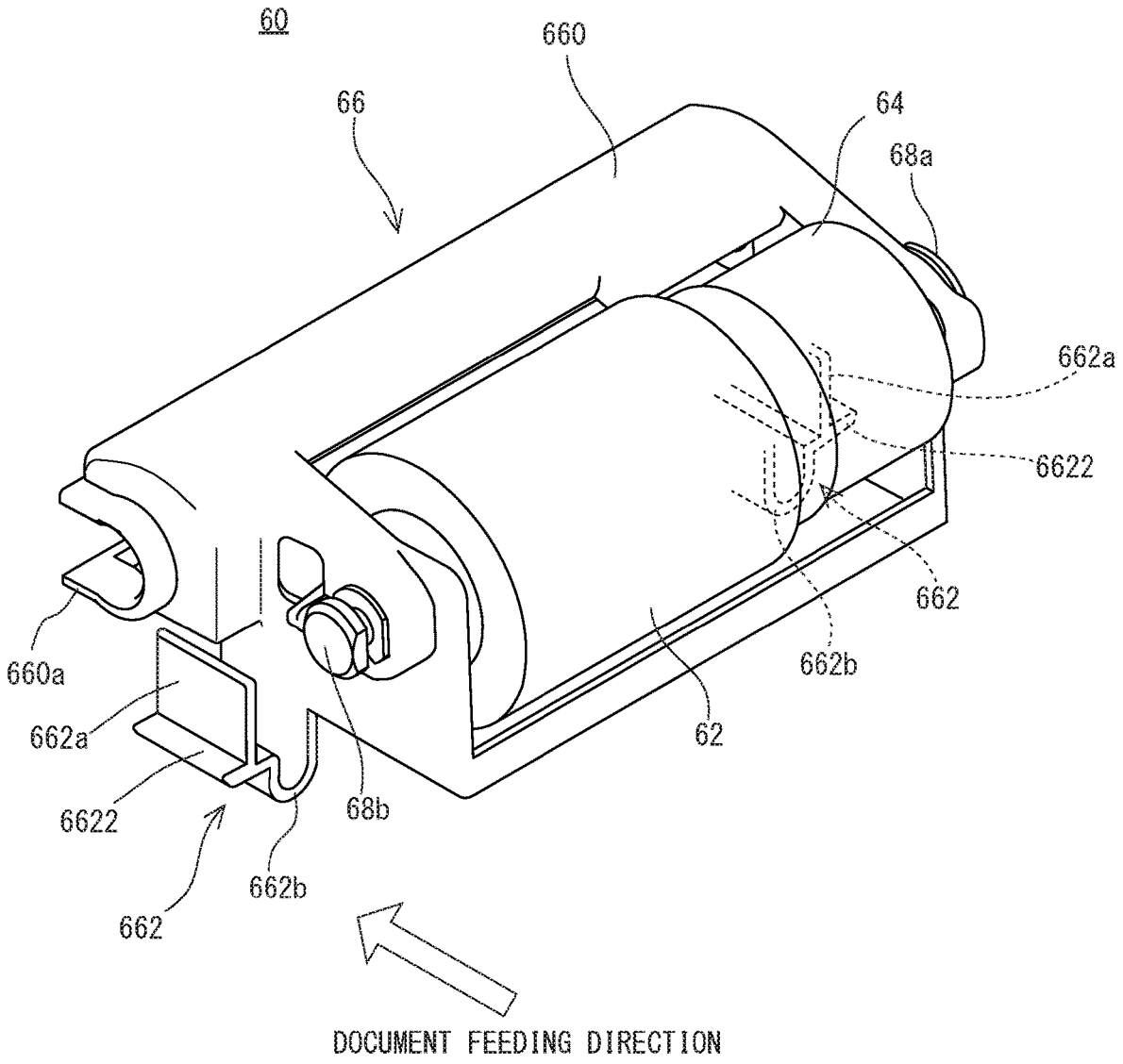
FIG. 14 is a perspective view showing an example of an appearance configuration of a sheet separation unit in a fifth embodiment.

FIG. 14 is a perspective view showing an example of an appearance configuration of a sheet separation unit 60 in the fifth embodiment. As shown in FIG. 14, in the fifth embodiment, an engaging claw 662 is formed in one end surface (right side surface) in a width direction of the holder 66, and an engaging claw 662 is formed in the other end surface (left side surface) in the width direction of the holder 66.

Furthermore, the two engaging claws 662 are arranged between the separation roller 62 and the hook 660*a* in the document feeding direction. Specifically, the two engaging claws 662 are arranged in the downstream side from the rotation axis of the separation roller 62 in the document feeding direction and in the upstream side from the hook 660*a*. That is, the two engaging claws 662 are arranged between the rotation axis of the separation roller 62 and the hook 660*a* in the document feeding direction.

Moreover, the two engaging claws 662 are respectively arranged in the left side and right side of the separation roller 62 as viewed from the upstream side (downstream side) of the document feeding direction. That is, the two engaging claws 662 are arranged beside the separation roller 62 as viewed from the upstream side in the document feeding direction. Specifically, it can be said that the two engaging claws 662 are arranged outside the position (width) where the separation roller 62 is provided in the left-right direction as viewed from the upstream side in the document feeding direction. Furthermore, it can be said that the two engaging claws 662 are arranged in end portions of the sheet separation unit 60 in the left-right direction as viewed from the upstream side in the document feeding direction. Moreover, it can be said that the two engaging claws 662 are arranged in end portions (left and right end portions) of the width direction of the holder 66 (sheet separation unit 60).

Furthermore, the two engaging claws 662 of are arranged in positions overlapping with the separation roller 62 in the document feeding direction. Furthermore, the two engaging claws 662 are arranged in positions facing the separation roller 62 in a direction orthogonally intersecting the document feeding direction (left-right direction of the sheet separation unit 60 as viewed from the upstream side in the document feeding direction).

However, on each of the two engaging claws 662 of the fifth embodiment, the first claw portion 6620 that is provided in the first embodiment is not formed. Although illustration is omitted, since the sheet separation unit 60 (holder 66) is pushed-up by the compression spring 58, even when the first claw portion 6620 is not formed, the two engaging claws 662 are not disengaged downwardly.

Furthermore, a connecting portion 662*b* of each of the two engaging claws 662 in the fifth embodiment is formed in a U-letter shape as viewed from the upstream side (or the downstream side) in the document feeding direction. Accordingly, in this fifth embodiment, the connecting portion 662*b* is elastically deformable in the left-right direction as viewed from the upstream side in the document feeding direction. Therefore, the engaging portion 662*a* is tilted toward a right side and a left side as viewed from the upstream side in the document feeding direction.

Figure 15:
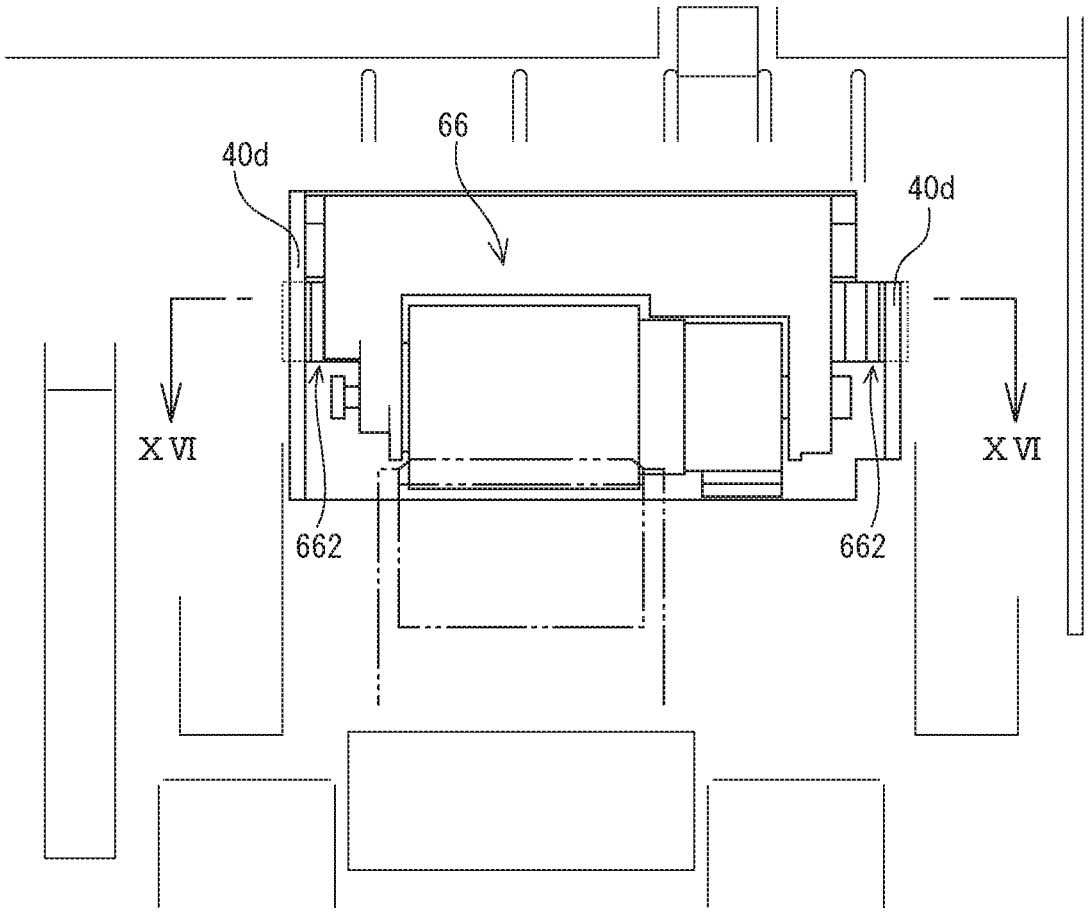
FIG. 15 is a schematic plan view showing structure of a part of a sheet feed apparatus in a state where the sheet separation unit of the fifth embodiment is attached.
Figure 16:
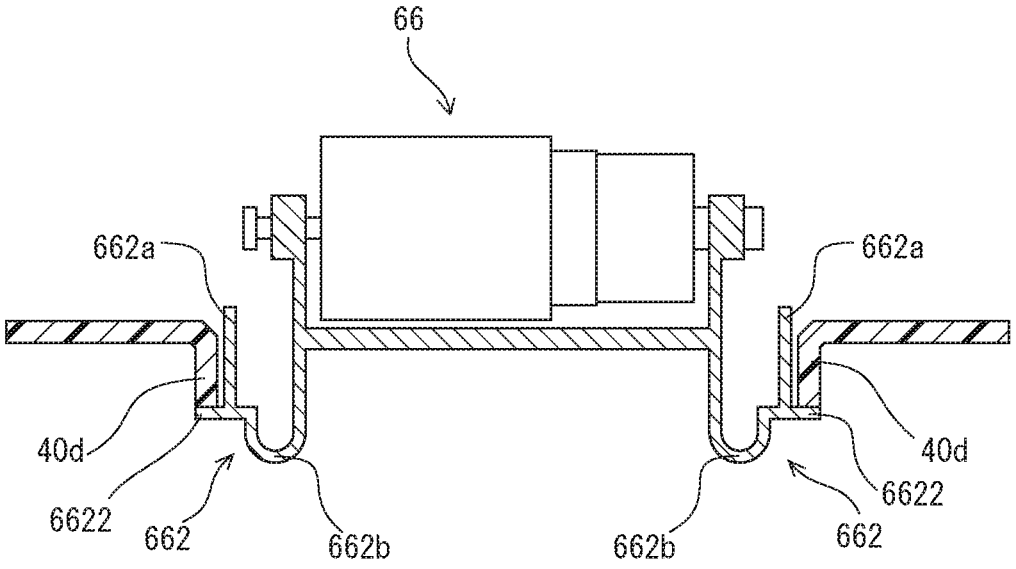
FIG. 16 is a schematic sectional view showing structure of a part of a sheet feed apparatus in a state where the sheet separation unit of the fifth embodiment is attached.

FIG. 15 is a schematic plan view showing structure of a part of the sheet feed apparatus 10 in the fifth embodiment in a state where the sheet separation unit 60 is attached. FIG. 16 is a schematic sectional view showing the structure of the part of the sheet feed apparatus 10 in the fifth embodiment in a state where the sheet separation unit 60 is attached.

As shown in FIG. 15 and FIG. 16, the engaging pieces 40*d* are formed on a left end portion and a right end portion of the accommodating portion 40*b* of the main body casing 40 as viewed from the upstream side in the document feeding direction. The engaging piece 40*d* that is formed in the right side of the accommodating portion 40*b* as viewed from the upstream side in the document feeding direction is extended toward the left side and bent downwardly in the left end portion. Furthermore, the engaging piece 40*d* that is formed in the left side of the accommodation portion 40*b* as viewed from the upstream side in the document feeding direction is extended toward the right side and bent downwardly in the right end portion. However, in an upper surface of a portion where the engaging pieces 40*d* are bent downwardly, chamfering processing is applied, and a slant surface that becomes a down slope toward a center line of the accommodating portion 40*b* parallel to the document feeding direction is formed.

When the sheet separation unit 60 is attached to the main body casing 40, opened portions of the connecting portions 662*b* of the two engaging claws 662 are elastically deformed, respectively. At this time, the sheet separation unit 60 is pushed-down (turned) in a state where the second claw portions 6622 of the two engaging claws 662 are not brought into contact with the engaging pieces 40*d*, or in a state where the second claw portions 6622 of the two engaging claws 662 are being brought into contact with the slant surface that is formed on the upper surface of the engaging pieces 40*d*.

Figure 17:
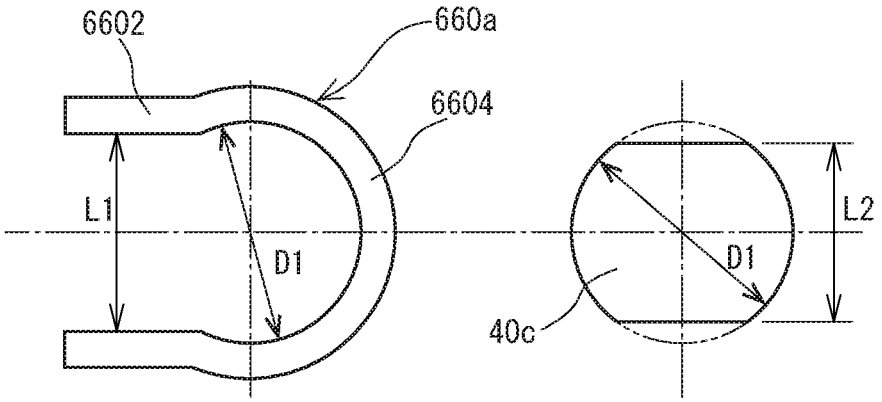
FIG. 17(A) is an illustration view showing a state before a hook is engaged with a projection in the fifth embodiment.
FIG. 17(B) is an illustration view showing a state where the hook is engaged with the projection in the fifth embodiment.
FIG. 17(C) is an illustration view showing a state where an engaging claw is engaged with an engaging piece in the fifth embodiment.
Figure 17B:
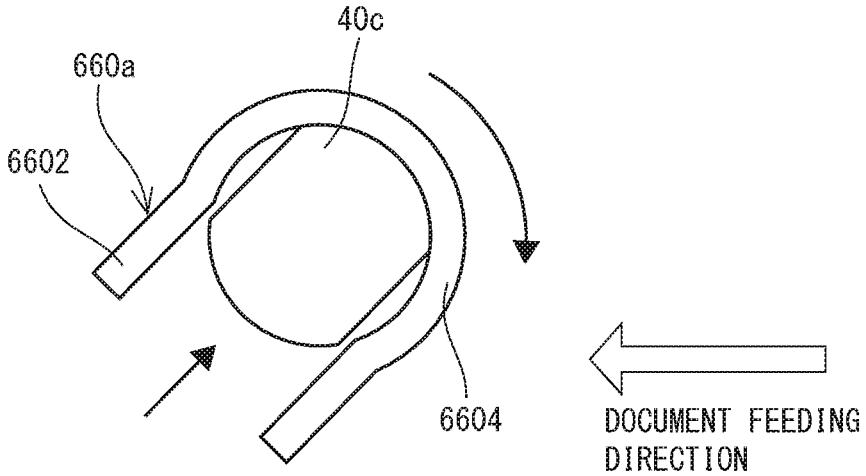
Figure 17C:
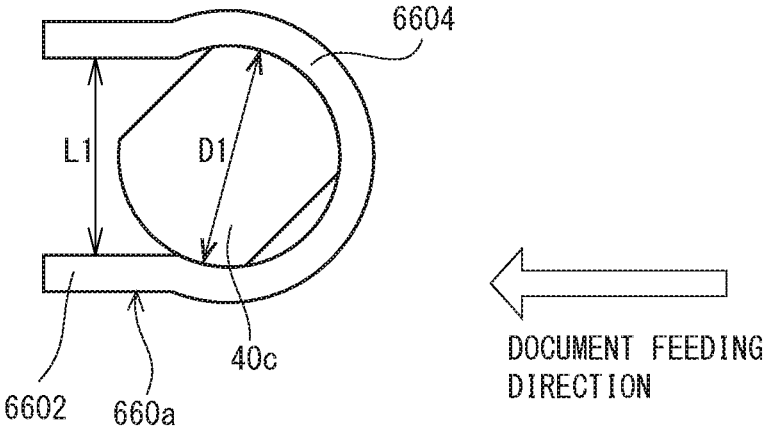

FIG. 17(A) is an illustration view showing a state before the hook is engaged with the projection in the fifth embodiment, FIG. 17(B) is an illustration view showing a state where the hook is engaged with the projection in the fifth embodiment, and FIG. 17(C) is an illustration view showing a state where the engaging claw is engaged with the engaging piece in the fifth embodiment.

Figure 18:
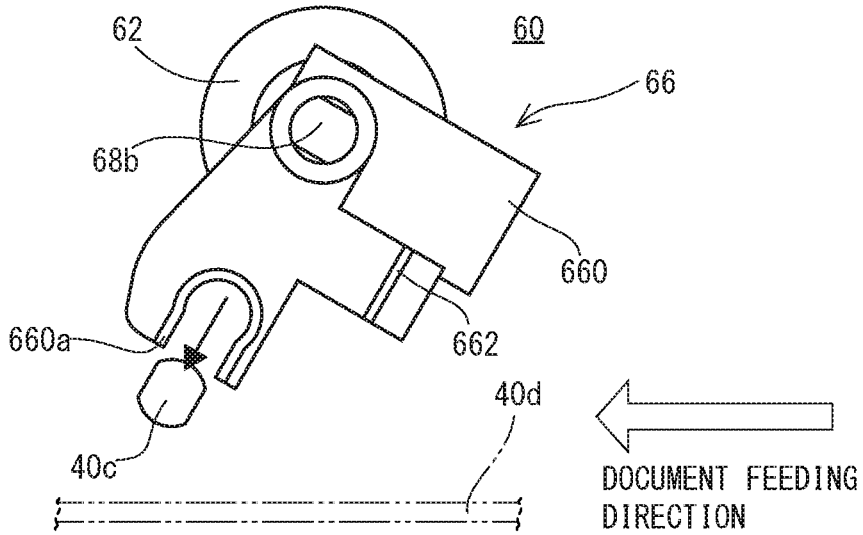
FIG. 18(A) is an illustration view showing a state before a hook is engaged with a projection in the fifth embodiment.
FIG. 18(B) is an illustration view showing a state where the hook is engaged with the projection in the fifth embodiment.
FIG. 18(C) is an illustration view showing a state where an engaging claw is engaged with an engaging piece in the fifth embodiment.
Figure 18:
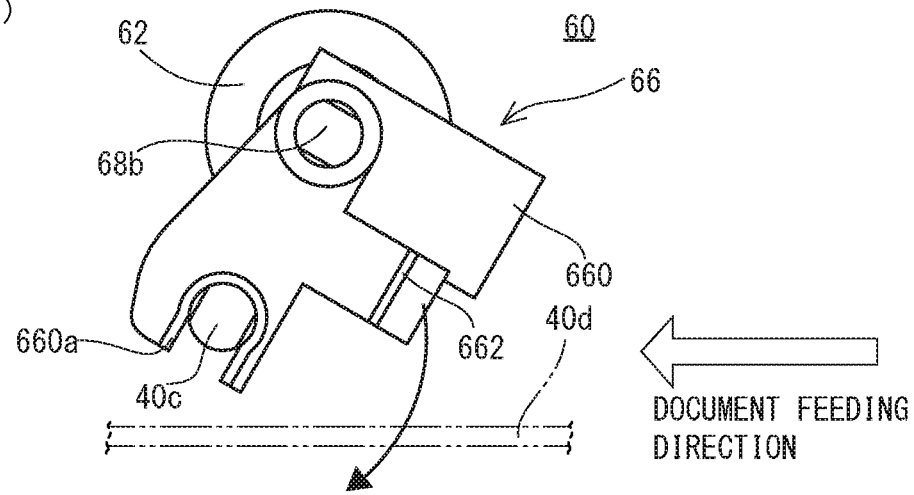
Figure 18:
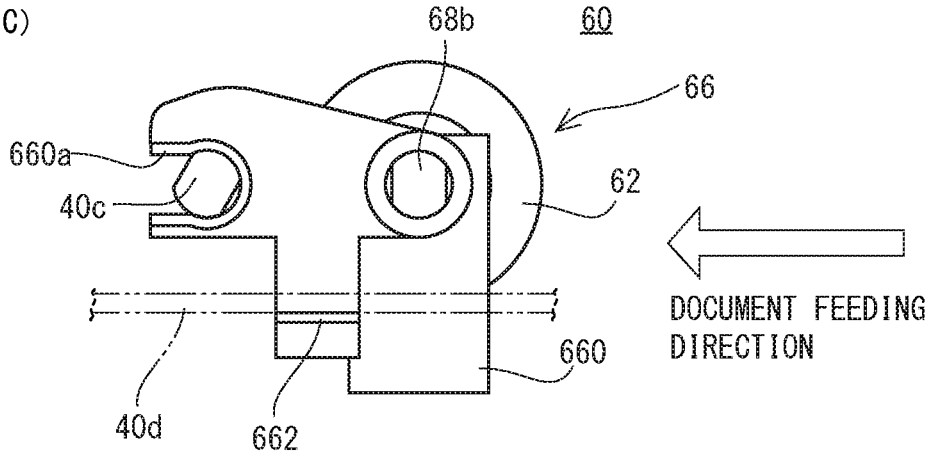

FIG. 18(A) is an illustration view showing a state before the hook is engaged with the projection in the fifth embodiment, FIG. 18(B) is an illustration view showing a state where the hook is engaged with the projection in the fifth embodiment, and FIG. 18(C) is an illustration view showing a state where the engaging claw is engaged with the engaging piece in the fifth embodiment.

As shown in FIG. 17(A), in the fifth embodiment, the hook 660*a* is constituted by an inlet portion 6602 and a bearing portion 6604, and the inlet portion 6602 and the bearing portion 6604 are connected to each other. The inlet portion 6602 is formed in a shape constituted by parallel plate members (plain plates) having the same length as viewed from a width direction (left-right direction as viewed from the upstream side in the document feeding direction) of the holder 66. The bearing portion 6604 is formed continuously to the inlet portion 6602 and in a shape constituted by a part of a cylinder as viewed from the width direction of the holder 66. That is, the bearing portion 6604 is constituted by a cylinder that a part of a side wall thereof is omitted (missed) and is connected to the inlet portion 6602 as viewed from the width direction of the holder 66.

However, a diameter (inner diameter of the bearing portion 6604) D1 of a circle constituting the bearing portion 6604 is larger than a distance (a size of interval) L1 between the two parallel plate members constituting the inlet portion 6602.

Furthermore, in the fifth embodiment, the projection 40*c* formed in the accommodating portion 40*b* has a shape that a part of a circular column is cut (removed). Specifically, the projection 40*c* has a shape that side surfaces of the circular column are cut in parallel. Accordingly, surfaces of a portion where the projection 40*c* are cut are planes in parallel with each other. As shown in FIG. 17(A), the side surfaces of the circular column are cut in parallel so that a cross section (end surface) becomes in a track form (long hole form) when viewing the projection 40*c* in an axial direction. Furthermore, it can be said that the cross section (end surface) of the projection 40*c* viewed in the axial direction is formed in a shape of an ellipse or oval.

Therefore, in the fifth embodiment, the inner diameter D1 of the bearing portion 6604 of the hook 660*a* is set up slightly larger than a diameter (diameter D2 of the column) of a portion where the side surface of the projection 40*c* is not cut. For example, when setting the inner diameter D1 of the bearing portion 6604 of the hook 660*a* as 4.1 mm-4.2 mm, the diameter D2 of the portion where the side surface of the projection 40*c* is not cut is set as 3.9 mm-4.0 mm.

Furthermore, the distance L1 between the two plate members that constitute the inlet portion 6602 of the hook 660*a* is set up slightly larger than a length of a portion where the side surfaces of the projection 40*c* are cut in parallel. For example, when setting the distance L1 between the two plate members constituting the inlet portion 6602 of the hook 660*a* as 3.1 mm-3.2 mm, the length L2 of a portion where the side surfaces of the projection 40*c* are cut in parallel is set as 2.9 mm-3.0 mm.

Furthermore, as shown in FIGS. 17(B) and 17(C), and FIGS. 18(A) to 18(C), surfaces (side surfaces) of the portion where the side surfaces of the projection 40*c* are cut in parallel have an inclination with respect to the document feeding direction. Specifically, the projection 40*c* is arranged so that each of the side surfaces of the cut portion has a down slope toward the downstream side of the document feeding direction.

Therefore, when attaching the sheet separation unit 60 to the main body casing 40, as shown in FIG. 18(A), the sheet separation unit 60 is moved according to the inclination of the side surfaces of the cut portion of the projection 40*c*. If the projection 40*c* is moved to the bearing portion 6604 of the hook 660*a* as shown in FIG. 17(B) and FIG. 18(B), the sheet separation unit 60 is rotated (turned) downward around an axis of the projection 40*c* as a rotation axis (turning axis). Then, if the sheet separation unit 60 is turned to a predetermined position as shown in FIG. 17(C) and FIG. 18(C), the engaging claw 662 is engaged with the engaging piece 40*d*. That is, the sheet separation unit 60 is attached to the main body casing 40.

As shown in FIG. 17(C) and FIG. 18(C), in a state where the engaging claw 662 is engaged with the engaging piece 40*d*, the portions not being cut (arc portion) of the projection 40*c* are brought into contact to the inner peripheral surface of the bearing portion 6604 of the hook 660*a*. That is, the projection 40*c* is fitted into the bearing portion 6604 of the hook 660*a*. Since the inner diameter D1 of the bearing portion 6604 of the hook 660*a* is slightly larger than the diameter (outer diameter) D2 of the arc portion of the projection 40*c* as described above, the sheet separation unit 60 (holder 66) is rotatable (turnable).

Furthermore, the distance L1 between the two plate members that constitute the inlet portion 6602 of the hook 660*a* is set up smaller than the diameter (outer diameter) D2 of the arc portion of the projection 40*c*. Therefore, after the projection 40*c* is fitted into the bearing portion 6604 of the hook 660*a*, the projection 40*c* is not separated from the bearing portion 6604. Accordingly, a movement of the sheet separation unit 60 in the document feeding direction is regulated at least.

According to the fifth embodiment, since the sheet separation unit 60 including the separation roller 62 is constituted to be attachable to or detachable from the main body casing 40 from the exterior, when replacing the separation roller 60, it is possible to perform replacing work of the separation roller 62 at hand of the worker while removing the sheet separation unit 60 from the main body casing 40. Therefore, the separation roller 62 can be easily replaced.

In addition, it is possible to apply a configuration shown in the fifth embodiment to not only the first embodiment but the fourth embodiment.

Sixth Embodiment

Since a sheet feed apparatus 10 of the sixth embodiment is the same as the sheet feed apparatus 10 of the first embodiment except that the hook 660*a* is provided in the upstream side of the holder 600 and the engaging claw 662 is provided in the downstream side of the holder 600, and that attaching structure of the sheet separation unit 60 to the main body casing 40 is changed, a duplicate description will be omitted or simplified. Furthermore, portions common to those in the above-described first embodiment will be described using the same reference numerals.

Figure 19:
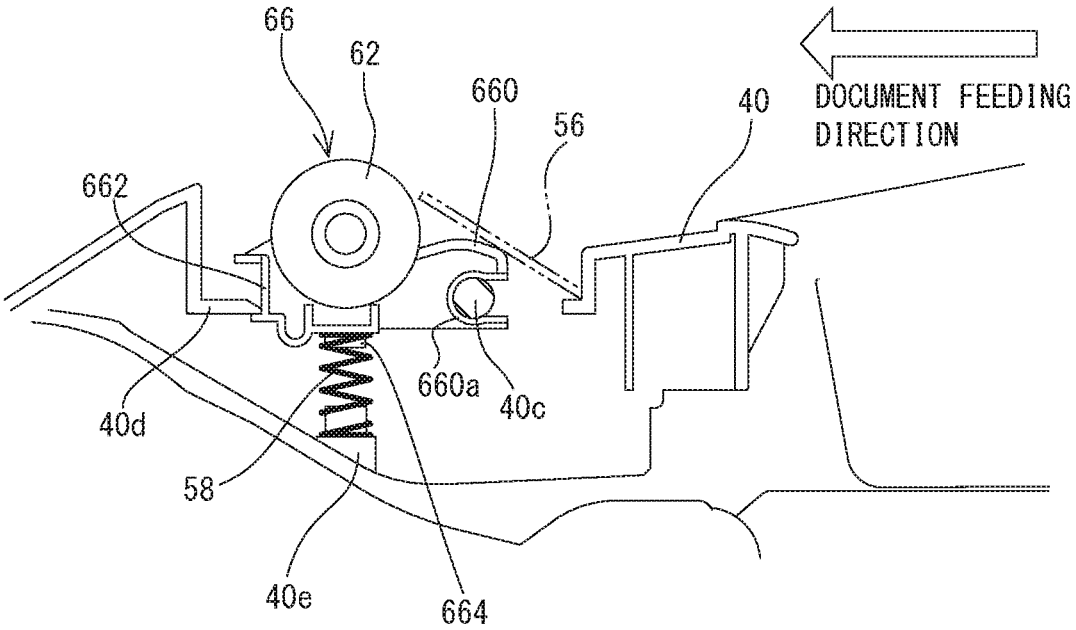
FIG. 19 is an illustration view showing attaching structure of a sheet separation unit in a sixth embodiment.

FIG. 19 is an illustration view for explaining attaching structure of the sheet separation unit 60 in a sixth embodiment. As shown in FIG. 19, in the sixth embodiment, the hook 660*a* is provided in an end portion of the upstream side of the holder 66. Furthermore, the engaging claw 662 is provided in an end portion of the downstream side of the holder 66. Thus, in the example shown in FIG. 19, the hook 660*a* is provided in the upstream side from the separation roller 62. The engaging claw 662 is provided in the downstream side from the separation roller 62.

However, the engaging claw 662 may be provided only one, and may be provided two or more. Furthermore, the engaging claw 662 may be arranged inside the position (width) where the separation roller 62 is provided (position facing the separation roller 62 in the document feeding direction) in the left-right direction as viewed from the upstream side of the document feeding direction, and may be arranged outside the position (width) where the separation roller 62 is provided. Moreover, the engaging claw 662 may be arranged inside the position (width) where the guide sheet 56 is provided (position facing the guide sheet 56 in the document feeding direction) in the left-right direction as viewed from the upstream side of the document feeding direction, and may be arranged outside the position (width) where the guide sheet 56 is provided.

However, a direction of the engaging claw 662 is a direction opposite to a direction of the engaging claw 662 in the first embodiment. Therefore, the first claw portion 6620 and the second claw portion 6622 are protruded toward the downstream side. Furthermore, the engaging piece 40*d* with which the engaging claw 662 is engaged is provided in the downstream side of the accommodating portion 40*b*, and extended toward the upstream side.

Furthermore, in the sixth embodiment, the projection 40*c* is provided in the upstream side from the separation roller 62. However, shapes of the projection 40*c* and the hook 660*a* are the same as those of the above-described fifth embodiment unlike the first embodiment. Therefore, also in the sixth embodiment, after the projection 40*c* is attached to the main body casing 40, a movement of the sheet separation unit 60 in the document feeding direction is regulated at least. However, a direction that planes formed on the side surface of the projection 40*c* are inclined is reverse to that of the fifth embodiment.

Although illustration is omitted, when attaching the sheet separation unit 60 to the main body casing 40, the hook 660*a* is first hooked on the projection 40*c* in the upstream side. Subsequently, the sheet separation unit 60 is moved downward around the projection 40*c* as a rotation axis, whereby the engaging claw 662 is engaged with the engaging piece 40*d*. At this time, since the connecting portion 662 is elastically deformed, the engaging portion 662*a* is tilted (turned) toward the upstream side.

Figure 20:
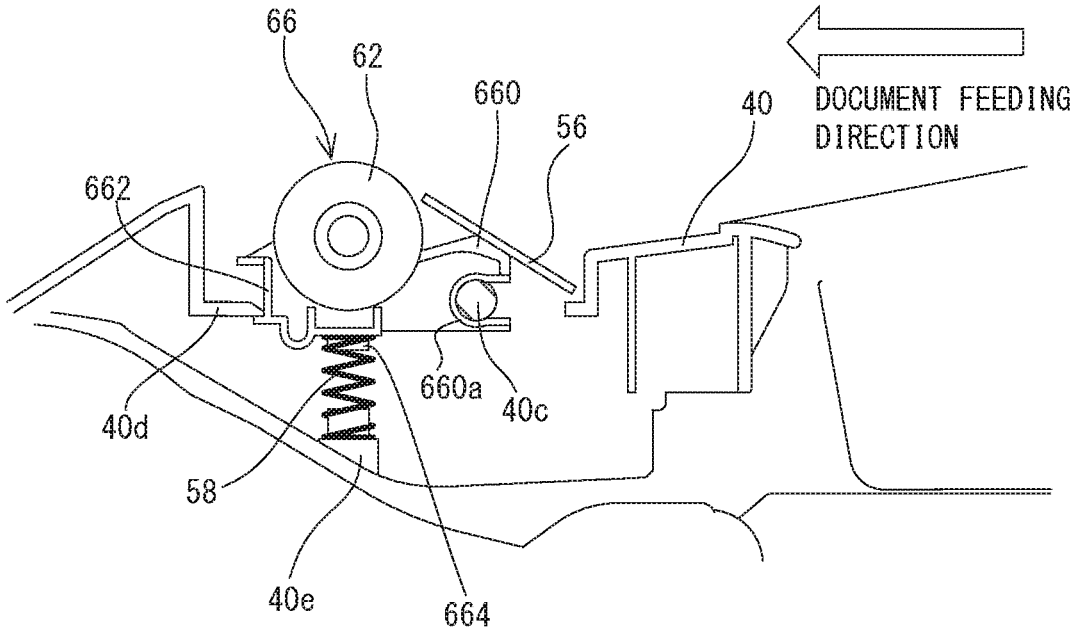
FIG. 20 is an illustration view showing attaching structure of a sheet separation unit in a modified example.

FIG. 20 is an illustration view showing attaching structure of the sheet separation unit 60 in a modified example. As shown in FIG. 20, the sheet separation unit 60 may be constituted so that the guide sheet 56 is included in the sheet separation unit 60. For example, the guide sheet 56 is attached to an upper end portion in the upstream side of the holder main body 660. In this case, an attaching surface for attaching the guide sheet 56 is formed in the upper end portion of the upstream side of the holder main body 660. This attaching surface is a plain surface parallel to the guide sheet 56 in a case where the sheet separation unit 60 is attached to the main body casing 40, for example, as shown in FIG. 19.

Furthermore, a position and a size of the guide sheet 56 are the same or approximately the same as the position and the size of the guide sheet 56 in the first embodiment. However, an end portion of the upstream side of the guide sheet 56 is located in the downstream side as compared with a case where the guide sheet 56 is provided in the main body casing 40. Accordingly, a gap is formed between the end portion the upstream side of the guide sheet 56 and the main body casing 40. Therefore, when attaching the sheet separation unit 60 to the main body casing 40, or when detaching the sheet separation unit 60 from the main body casing 40, even if the sheet separation unit 60 is turned, the guide sheet 56 does not collide with the main body casing 40.

According to also this sixth embodiment, since the sheet separation unit 60 including the separation roller 62 is constituted to be attachable to or detachable from the main body casing 40 from the exterior, in replacing the separation roller 62, it is possible to perform replacing work of the separation roller 62 at hand of the worker while removing the sheet separation unit 60 from the main body casing 40. Therefore, the separation roller 62 can be easily replaced.

In addition, a configuration shown in the sixth embodiment can be applied to not only the first embodiment but the fourth embodiment.

Furthermore, although a case where the engaging claw 662 is provided in the end portion of the downstream side of the holder 66 is described as an example in the sixth embodiment, it does not need to be limited to this. For example, the engaging claw 662 may be arranged at the right and left of the separation roller 62 as viewed from the upstream side (or the downstream side) of the document feeding direction. That is, the engaging claw 662 may be arranged beside the separation roller 62 as viewed from the upstream side of the document feeding direction. Furthermore, the engaging claw 662 may be arranged between the separation roller 62 and the hook 660*a* in the document feeding direction. Moreover, the engaging claw 662 may be arranged in a position overlapping with the separation roller 62 in the document feeding direction. Furthermore, the engaging claw 662 may be arranged in a position facing the separation roller 62 in a direction orthogonally intersecting the document feeding direction (the left-right direction of the sheet separation unit 60 as viewed from the upstream side of the document feeding direction). However, the engaging claw 662 is provided in the downstream side from the hook 660*a* also in these cases.

As described above, although the present invention has been described with reference to specific embodiments thereof, the present invention is not limited to the above-described embodiments. It should be noted that the above-described specific embodiments are only examples, and to be changed appropriately in accordance with specifications of the actual products.

Although the present invention has been described and illustrated in detail, it is clearly understood that the same is by way of illustration and example only and is not to be taken by way of limitation, the spirit and scope of the present invention being limited only by the terms of the appended claims. Furthermore, it is intended that the scope of the present invention covers all modifications within the meaning and range of equivalency of the claims.

What is claimed is:

1. A sheet feed apparatus, comprising:

a sheet placing tray for placing sheets, provided on an apparatus main body;

a sheet feed roller feeding the sheets picked-up from the sheet placing tray; and a sheet separation unit including a separation member that is provided so as to be brought into contact with an outer peripheral surface of the sheet feed roller and separates the sheets fed by the sheet feed roller into one, wherein the sheet separation unit is held on the apparatus main body by a support portion that supports the sheet separation unit rotatably on the apparatus main body and an engaging portion having a claw portion that engages, by elastic deformation, the sheet separation unit on the apparatus main body, and the support portion is provided in an upstream side from the engaging portion and the sheet separation unit in a sheet feeding direction and is provided with an interval to the separation member in the sheet feeding direction, the engaging portion is provided within a width of the separation member in a direction orthogonally intersecting the sheet feeding direction, and the engaging portion is provided in a position opposite to a center portion of the separation member in the direction orthogonally intersecting the sheet feeding direction, wherein the engaging portion engages with the apparatus main body, the engaging portion includes a first claw and a second claw, the first claw and the second claw are projected toward a downstream side in the sheet feeding direction, and the first claw and the second claw are provided at an interval in an up and down direction.

2. The sheet feed apparatus according to claim 1, wherein the engaging portion is provided in a downstream side from the separation member in the sheet feeding direction and is provided with an interval to the separation member in the sheet feeding direction.

3. The sheet feed apparatus according to claim 1, further comprising a guide member that is provided so as to face the separation member in an upstream side from the sheet separation unit in the sheet feeding direction, and guides the sheets to a nip portion between the sheet feed roller and the separation member, wherein the sheet separation unit includes the guide member.

4. The sheet feed apparatus according to claim 3, wherein the sheet separation unit includes a holder having the separation member, the support portion and the engaging portion, and the guide member is provided on the holder.

5. The sheet feed apparatus according to claim 3, wherein the guide member is made of a material having flexibility and forms a shape of sheet.

6. The sheet feed apparatus according to claim 1, wherein the separation member is one of a separation roller and a separation pad.

7. The sheet feed apparatus according to claim 1, further comprising a guide member that is provided so as to face the separation member in an upstream side from the separation member in the sheet feeding direction, and guides the sheets to a nip portion between the sheet feed roller and the separation member, the guide member being arranged downstream of the sheet placing tray in the sheet feeding direction, wherein the guide member is arranged adjacent to the separation member.

8. The sheet feed apparatus according to claim 1, wherein the sheet separation unit is provided attachably to or detachably from the sheet feed apparatus.

9. The sheet feeding apparatus according to claim 1, further comprising a connecting portion that is connected to the engaging portion and is formed in a U-letter shape.

10. The sheet feeding apparatus according to claim 1, wherein the first claw is provided on an upper end portion of the engaging portion and the second claw is provided on a lower end portion of the engaging portion.

11. An image forming apparatus comprising the sheet feed apparatus according to the claim 1.

* * * * *